US005970688A

United States Patent [19]

Nyiendo et al.

[11] Patent Number: 5,970,688

[45] Date of Patent: Oct. 26, 1999

[54] APPARATUS FOR OPENING POUCHES FOR INSERTION OF OBJECTS THEREINTO

[75] Inventors: Taifa Nyiendo, Somerset; Andrew Chaloka, Clark; Robert Nunez, Asbury, all of N.J.

[73] Assignee: Ethicon, Inc., Somerville, N.J.

[21] Appl. No.: 09/014,841

[22] Filed: Jan. 28, 1998

[51] Int. Cl.[6] ..... B65B 43/14

[52] U.S. Cl. ..... 53/573; 53/571; 53/381.6; 53/386.1

[58] Field of Search ..... 53/569, 570, 571, 53/573, 284.3, 386.1, 381.6, 53

[56] References Cited

U.S. PATENT DOCUMENTS

| | | |
|---|---|---|
| 3,501,893 | 3/1970 | Peterson . |
| 3,698,451 | 10/1972 | Hudson . |
| 3,750,365 | 8/1973 | Darby, Jr. et al. . |
| 3,750,721 | 8/1973 | Hudson . |
| 3,971,189 | 7/1976 | Mojden et al. . |
| 4,319,444 | 3/1982 | Russell . |
| 4,537,015 | 8/1985 | Inglett, Jr. et al. . |
| 4,541,227 | 9/1985 | Coad et al. . |
| 4,561,238 | 12/1985 | Odom . |
| 4,723,353 | 2/1988 | Monforte . |
| 4,726,170 | 2/1988 | Sawa et al. . |
| 4,823,538 | 4/1989 | Takamura . |
| 4,869,052 | 9/1989 | Calvert . |
| 5,115,619 | 5/1992 | Lieder . |
| 5,140,801 | 8/1992 | Wild . |
| 5,179,819 | 1/1993 | Sukeyasu et al. . |
| 5,265,397 | 11/1993 | DePoint et al. . |
| 5,314,293 | 5/1994 | Carlisle et al. . |
| 5,409,347 | 4/1995 | Suzuki . |
| 5,568,715 | 10/1996 | Ebel et al. . |

*Primary Examiner*—John Sipos
*Assistant Examiner*—Steven Jensen

[57] ABSTRACT

Apparatus for opening an open end of a pouch, an overwrap, or the like so as to facilitate the insertion of an object thereinto includes a number of processing stations, such as a storage station where a supply of pouches is stored and an opening station where an open end of a pouch transported thereto from the storage station is opened so as to receive an object. A transporting mechanism, which includes a suction-type gripper, transports a pouch from the storage station to the opening station and then from the opening station to another station, which may or may not be a processing station. The suction-type gripper of the transporting mechanism continuously grips a pouch throughout its movement from station to station. The opening station may be provided with its own pair of suction-type grippers which cooperate to open a pouch which has been transported to the opening station. Other processing stations include an inspection station for inspecting a pouch transferred from the opening station and a sealing station for sealing a properly filled pouch. The last station is an unloading station having its own suction-type gripper adapted to receive a sealed pouch which is handed off by the suction-type gripper of the transporting mechanism.

48 Claims, 21 Drawing Sheets

APPARATUS FOR OPENING POUCHES FOR INSERTION OF OBJECTS THEREINTO

FIELD OF THE INVENTION

The present invention relates to packaging machines, and, more particularly, to packaging machines adapted for facilitating the loading of contents of medical products or the like in overwraps, pouches, or the like.

BACKGROUND OF THE INVENTION

In the past, various packaging machines have been developed for filling or loading pouches, bags, or the like (see, for instance, U.S. Pat. Nos. 3,501,893, 3,698,451, 3,750,365, 3,750,721, 3,971,189, 4,319,444, 4,537,015, 4,541,227, 4,561,238, 4,726,170, 4,823,538, 4,869,052, 5,115,619, 5,140,801, 5,179,819, 5,265,397, and 5,568,715). These machines typically have a number of stations performing various functions. For instance, some of these machines have a supply station containing a supply of pouches, a loading station having an opening mechanism for opening an open end of a pouch such that contents can be inserted into the pouch, and a sealing station adapted to seal the open end of a loaded pouch.

It has been known to utilize robot arms for material handling applications (see, for instance, U.S. Pat. Nos. 4,723,353, 5,314,293, and 5,409,347). Accordingly, some of the foregoing packaging machines utilize robot-like arms equipped with, for instance, suction cups for transporting pouches from one station to another station. Pouches carried by these robot arms are typically passed off (i.e., transferred) to other transporting devices, such as clamps, for transporting the pouches to other stations for further processing. For various reasons (e.g., increased time requirements caused by passing off pouches from one transporting device to another transporting device), the utilization of more than one transporting device is disadvantageous.

SUMMARY OF THE INVENTION

The present invention overcomes the disadvantages and shortcomings of the packaging machines described above by providing a new and improved apparatus for opening an open end of a pouch, an overwrap, or the like so as to facilitate the insertion of an object thereinto. The apparatus includes storing means located at a first station for storing a supply of pouches therein; opening means located at a second station for opening an open end of a pouch transported thereto from the first station, thereby enabling a pouch transported to the second station to receive an object; and transporting means for transporting a pouch from the first station to the second station and then from the second station to a third station. The transporting means includes first suction-operated gripping means for gripping a pouch stored at the first station, the gripping means being operable to continuously grip a pouch throughout its movement from the first station to the third station. Because there is no transferring (i.e., passing or handing off) of the pouch between the first and third stations, the present invention is more efficient and less complicated than the packaging machines described above.

With respect to the opening means, it includes second suction-operated gripping means for gripping a pouch transported to the second station by the transporting means, the second gripping means being movable relative to the first gripping means to thereby at least partially open a pouch transported to the second station by the transporting means.

The opening means may also include third suction-operated gripping means which cooperates with the second gripping means to open a pouch transported to the second station by the transporting means, as well as with depressing means for depressing an edge of an open end of a pouch during the performance of a pouch opening operation at the second station, whereby the depressing means facilitates the pouch opening operation being performed by the second and third gripping means. More particularly, the depressing means includes a tongue which is movable between a first position, in which the tongue is out of engagement with a pouch which is to be opened at the second station, and a second position, in which the tongue is engageable with a pouch during the performance of a pouch opening operation at the second station, whereby the tongue widens an open end of a pouch as the tongue moves from its first position to its second position.

In one embodiment, the first gripping means includes a first support member, such as an end effector of a robot arm assembly, and an array of first suction cups arranged on the first support member such that they are positionable below a pouch which is therefore carried on the first suction cups throughout the movement of the first gripping means from the first station to the third station. The first gripping means may also be provided with first actuating means for individually and selectively actuating at least some of the first suction cups such that the number that are actuated can be varied depending upon pouch length, as well as with first mounting means for mounting the first suction cups on the first support member such that the first suction cups are movable toward and away from the first support member.

In one embodiment, the second gripping means includes a second support member and an array of second suction cups arranged on the second support member, while the third gripping means includes a third support member and an array of third suction cups arranged on the third support member. Second actuating means may also be provided for individually and selectively actuating at least some of the second suction cups and a corresponding number of the third suction cups such that the number that are actuated can be varied depending upon pouch width. The second and third suction cups can be mounted on the second and third support members, respectively, such that they are movable toward and away from their respective support members.

The apparatus may also include inspecting means for inspecting a pouch transported from the second station, as well as with sealing means for sealing an open end of a pouch which has been loaded with an object. The inspecting means includes a camera for taking an image of a pouch to determine if it has been properly loaded, while the sealing means includes a heating element movable toward and away from an open end of a pouch positioned between the heating element and an opposing support member.

After the performance of a sealing operation, the transporting means transports the sealed pouch to an ejection station which includes unloading means for unloading a pouch from the transporting means. In one embodiment, the unloading means includes fourth suction-operated gripping means for gripping a pouch transported to the ejection station by the transporting means. Controlling means controls the first and fourth gripping means such that the first gripping means is deactuated upon the actuation of the fourth gripping means, whereby a pouch is transferable from the first gripping means to the fourth gripping means.

BRIEF DESCRIPTION OF THE DRAWINGS

For a more complete understanding of the present invention, reference is made to the following detailed description of an exemplary embodiment considered in conjunction with the accompanying drawings, in which.

DETAILED DESCRIPTION OF THE EXEMPLARY EMBODIMENT

Figure 1:
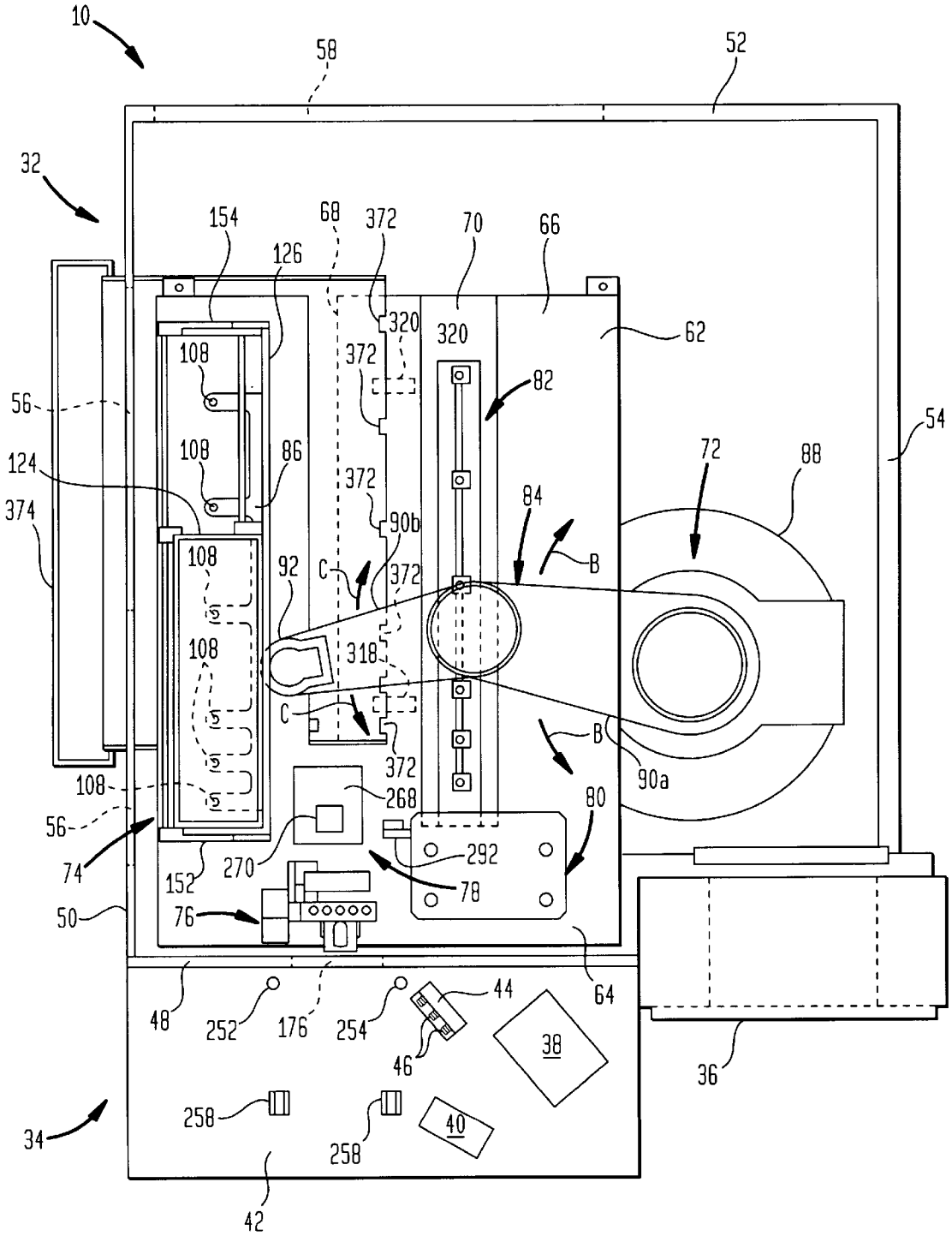
FIG. 1 is a top plan view of a packaging machine constructed in accordance with the present invention.

FIG. 1 shows a packaging machine 10 adapted for facilitating the packaging of contents or devices 12 of medical or hygienic products in overwraps or pouches 14 (see FIG. 4) to form sealed packages. While the construction of the overwraps 14 is well known in the art, for the purpose of facilitating consideration and discussion, it will be briefly discussed below. It should, however, be understood that the following description of the overwraps 14 is not meant to limit the scope of the present invention, which can be used with many different types of overwraps, pouches, and the like.

Figure 4:
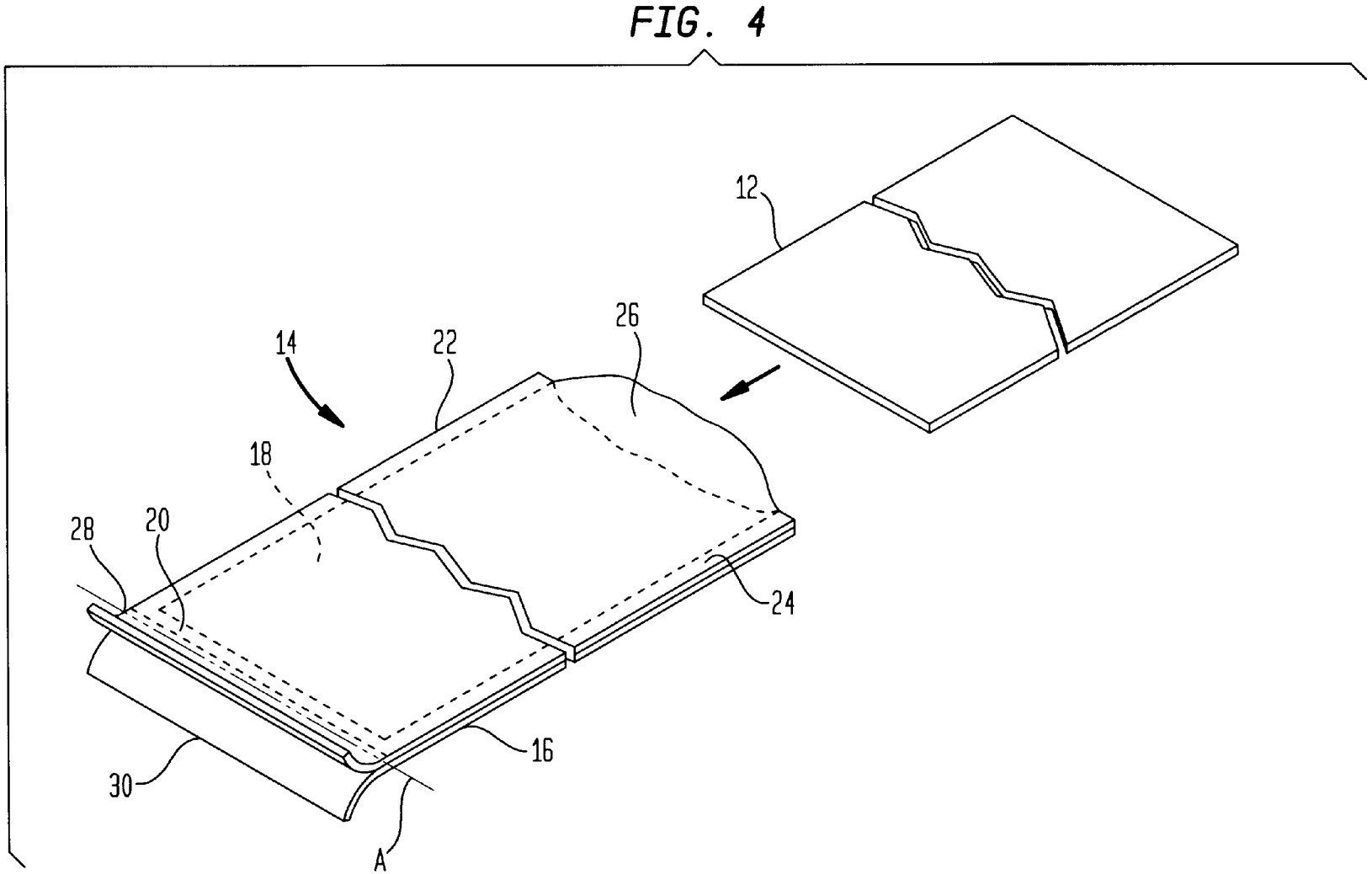
FIG. 4 is a schematic view of contents and an overwrap of a medical or hygienic product.

Referring to FIG. 4, each of the overwraps 14 for use in packaging contents or devices 12 has a semi-opaque sheet 16 and a transparent or translucent sheet 18 attached to each other. The sheets 16, 18 are pre-sealed at a rear end 20 and sides 22, 24 thereof in a conventional manner. A front (i.e, leading) end 26 of the overwrap 14 is open (i.e., unsealed) to receive the contents 12 and to be heat-sealed thereafter in a conventional manner, thereby forming a sealed package (i.e., the overwrap 14 sealed with the contents 12 therein). The semi-opaque and transparent sheets 16, 18 form flaps 28, 30, respectively, at the rear end 20 for use in opening the sealed package by pulling the flaps 28, 30 away from each other. The flaps 28, 30 are normally folded onto the transparent sheet 18 along a fold line A.

Figure 2:
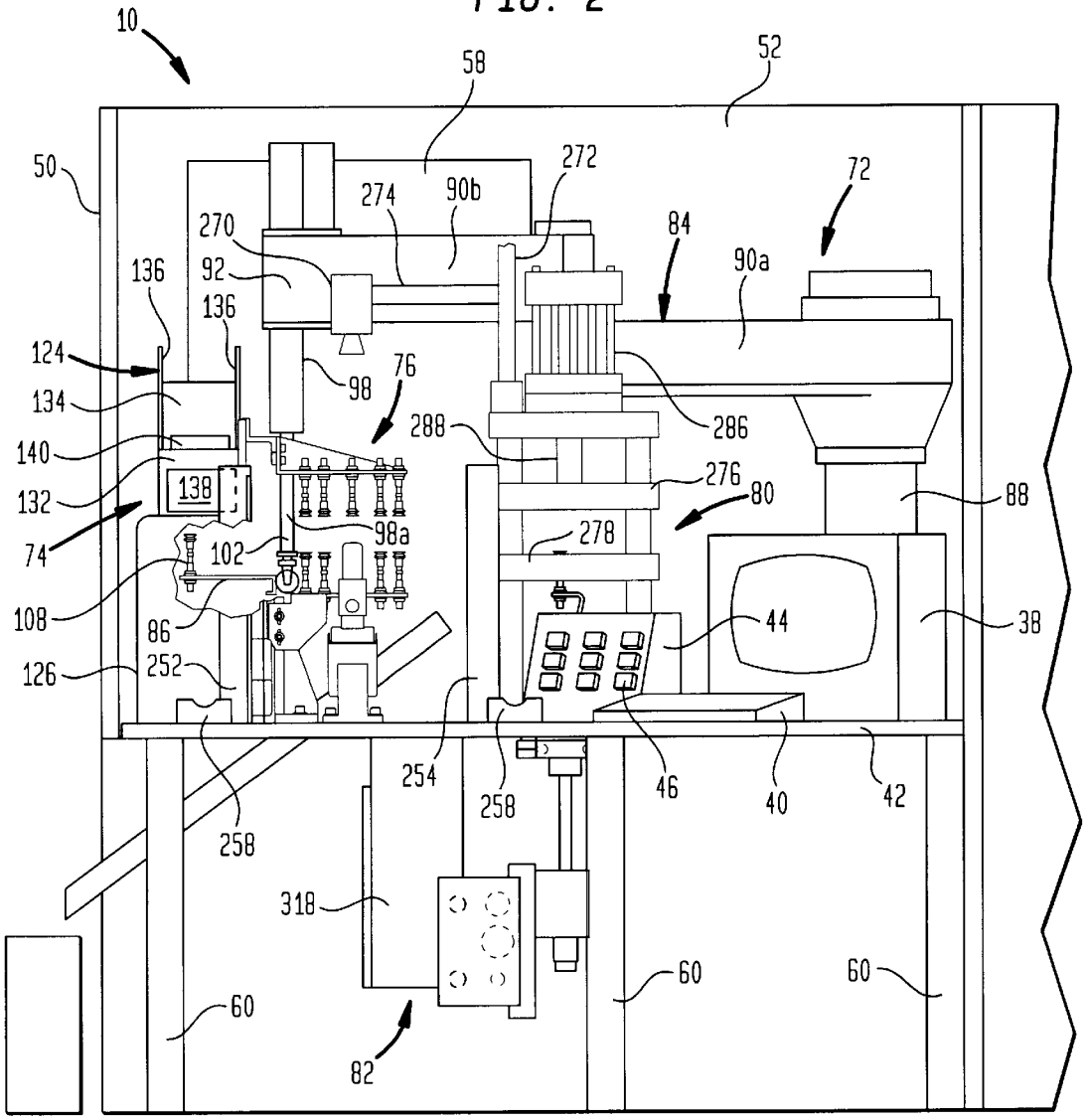
FIG. 2 is a partially broken-away front elevational view of the packaging machine shown in FIG. 1.
Figure 3:
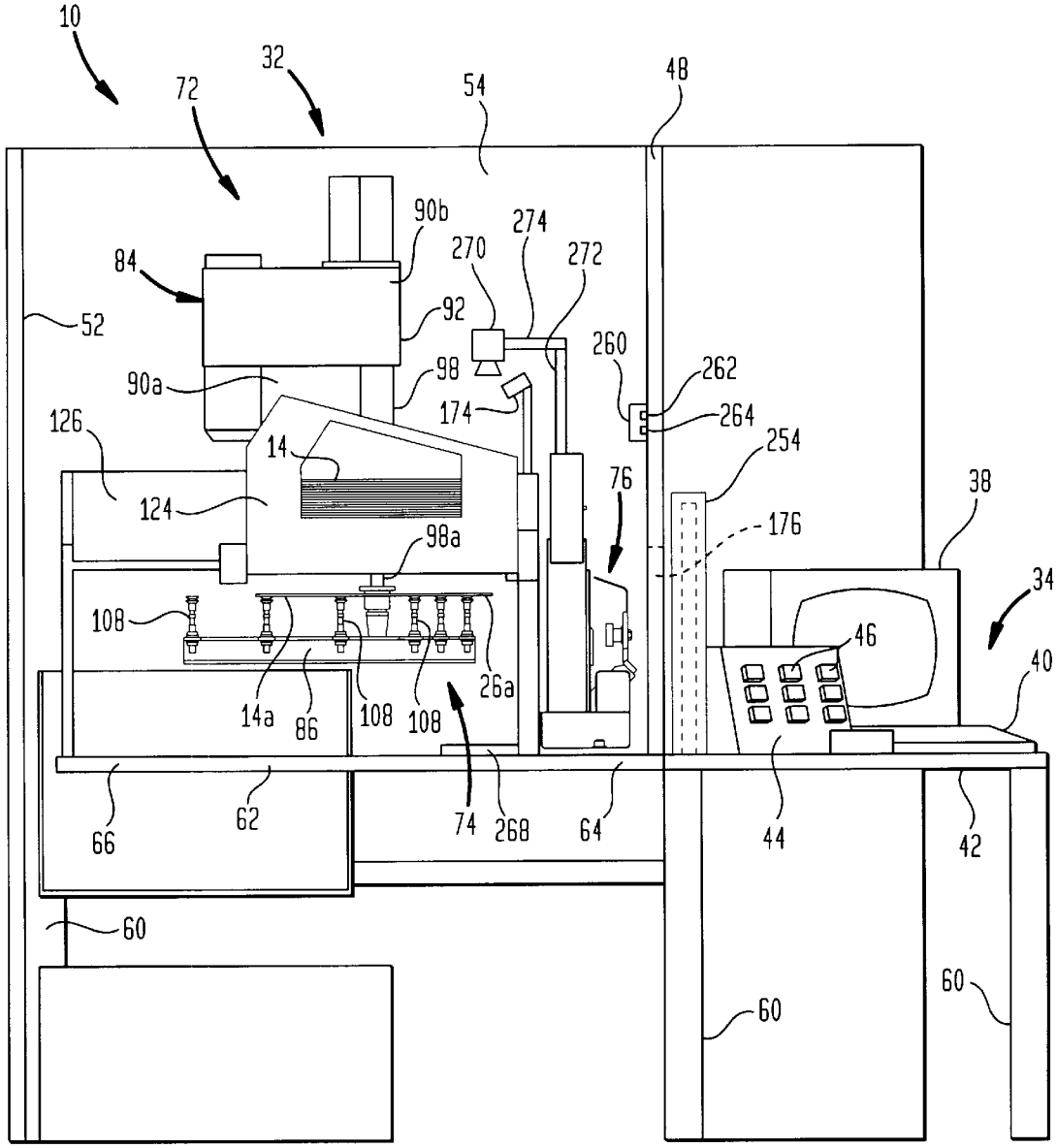
FIG. 3 is a side elevational view of the packaging machine shown in FIGS. 1 and 2.

With reference to FIGS. 1–3, the packaging machine 10 has a machine section 32 and an operator section 34 positioned adjacent the machine section 32 (see FIGS. 1 and 3). The packaging machine 10 is also equipped with a controller 36 (see FIG. 1), which is programmed with predetermined instructions in a conventional manner, for controlling the operation of the packaging machine 10. Various input and output devices communicating with the controller 36 are provided in the operator section 34 for allowing an operator stationed thereat to monitor and control the operation of the packaging machine 10. For instance, a display unit 38 (e.g., a monitor) and a keyboard 40 are supported on a table top 42 of the operator section 34. In addition, a control panel 44 is positioned on the table top 42 and includes various switches 46, such as a "start" switch and a "stop" switch, connected to the controller 36 for selectively controlling the operation of the packaging machine 10.

Still referring to FIGS. 1–3, the machine section 32 is provided with safety panels 48, 50, 52, 54 defining the machine section 32. The safety panel 48 is placed between the machine section 32 and the operator section 34 and thereby divides the machine section 32 from the operator section 34. The safety panel 52 is positioned at a rear end of the packaging machine 10 opposite the safety panel 48, while the safety panels 50, 54 extend between the safety panels 48, 52 along opposite sides of the machine section 32. The safety panels 50, 52 are provided with access doors 56, 58, respectively, for providing access to the inside of the machine section 32. Some or all of the safety panels 48, 50, 52, 54 are transparent or translucent such that the operation of the packaging machine 10 can be visually monitored therethrough by an operator stationed at the operator section 34 or around the packaging machine 10. The machine section 32 is also provided with a support frame 60 (see FIGS. 2 and 3) and a support top 62 (see FIGS. 1 and 3) positioned on the support frame 60. The support top 62 has a front end 64 adjacent the operator section 34 and a rear end 66 opposite the front end 64 (i.e., adjacent the safety panel 52). Channels 68, 70 are formed in the support top 62 for purposes to be discussed hereinafter.

With reference to FIGS. 1–3, the machine section 32 also includes a robot arm assembly 72, a picking station 74, a product insertion station 76, an inspection station 78 (see FIG. 1), a sealing station 80 (see FIGS. 1 and 2) and a product ejection station 82 (see FIG. 1). The picking station 74, the product insertion station 76, the inspection station 78, the sealing station 80 and the product ejection station 82, all of which are supported on or from the support top 62 of the machine section 32, are adapted to perform different tasks during various stages of the packaging operation of the packaging machine 10 (i.e., a picking operation, a product insertion operation, an inspection operation, a sealing operation, and a product ejection operation, respectively), while the robot arm assembly 72 is adapted to receive an unsealed (i.e., open) overwrap 14 from the picking station 74 and to then carry same to the other stations. To facilitate consideration and discussion, the robot arm assembly 72 and each of the stations identified above (i.e., the picking station 74, the product insertion station 76, the inspection station 78, the sealing station 80, and the product ejection station 82) will be discussed hereinafter in greater detail on an individual basis.

The Robot Arm Assembly

Figure 21A:
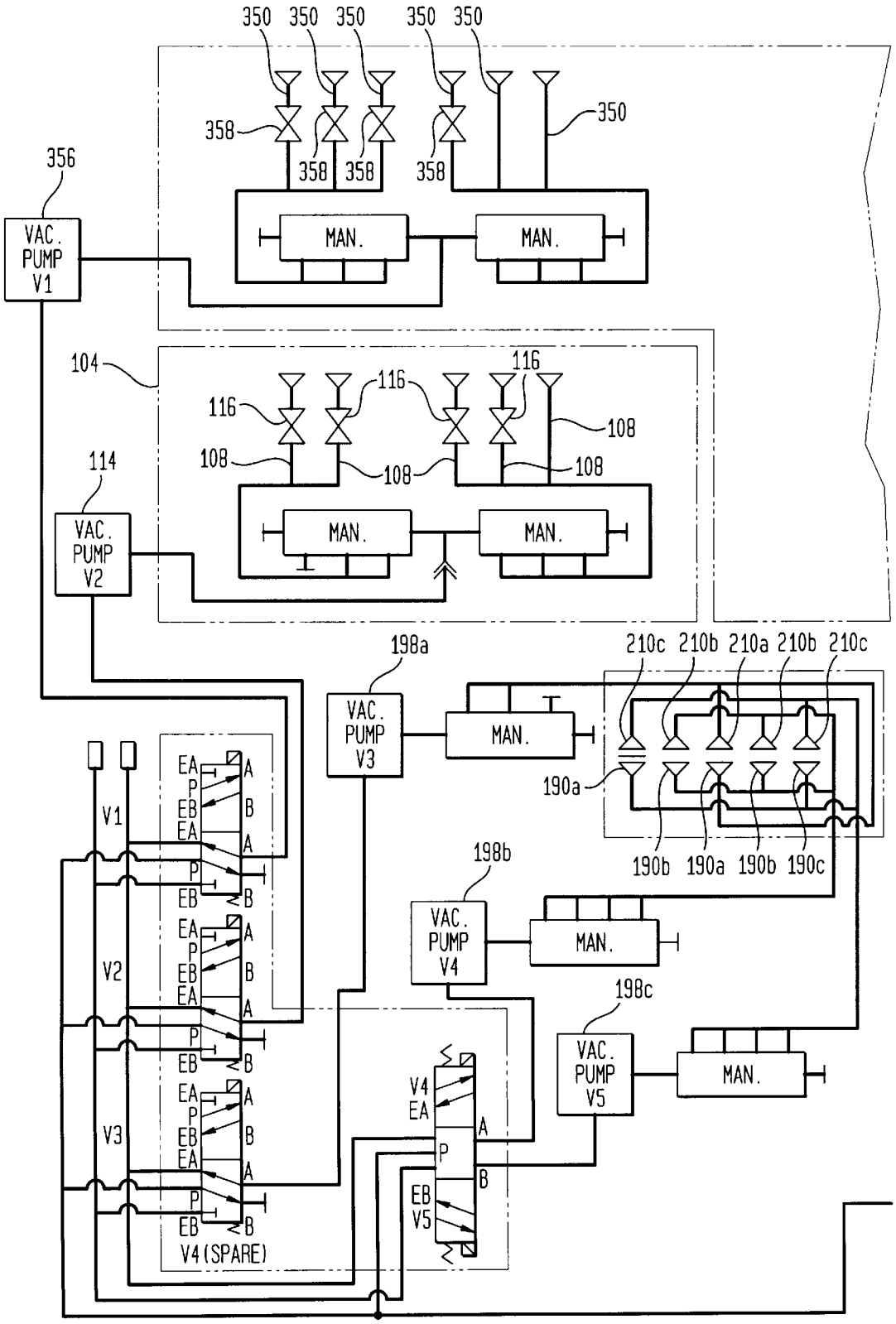
FIG. 21 is a schematic view of a pneumatic system of the packaging machine shown in FIGS. 1–3.
Figure 21B:
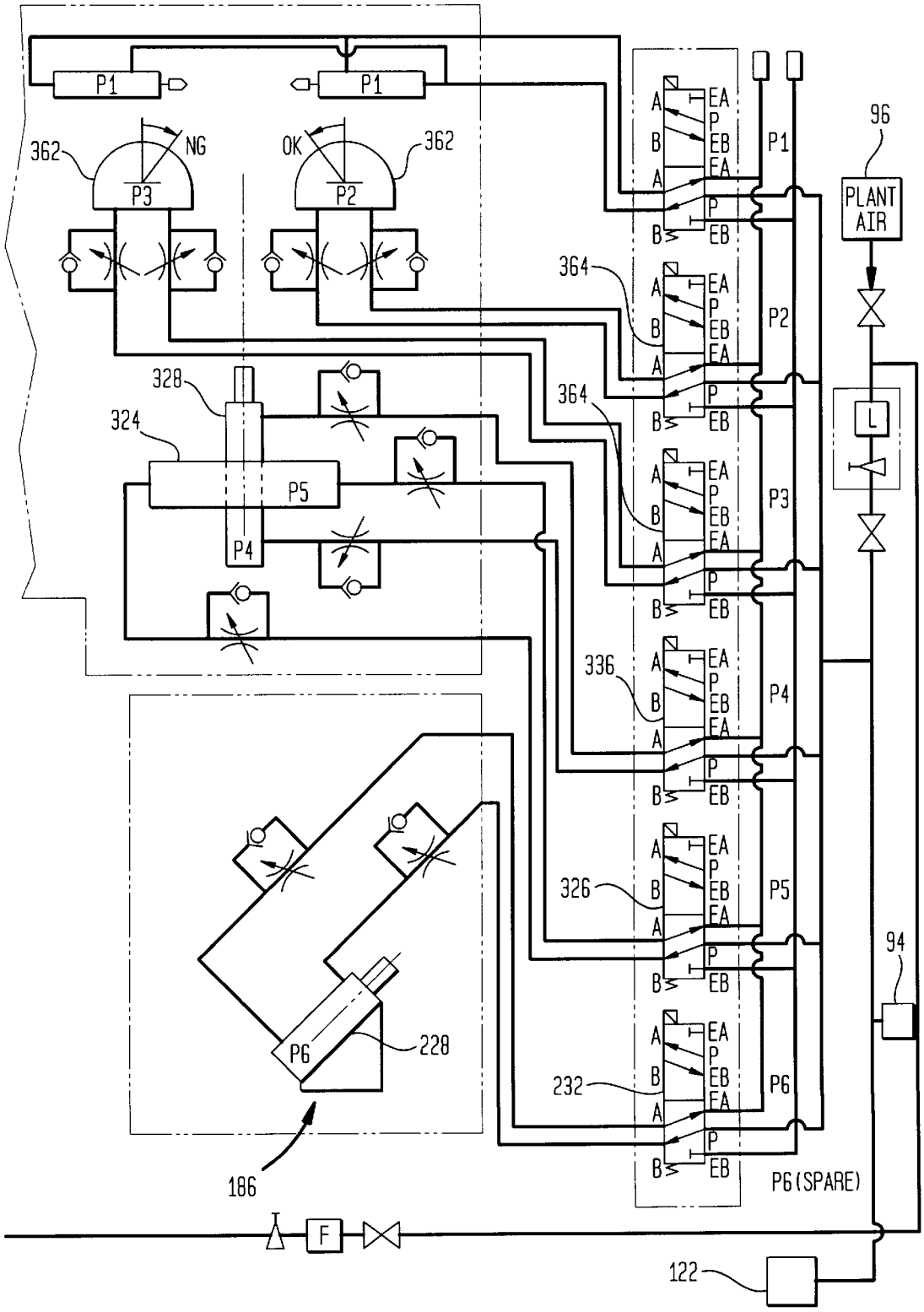

Referring to FIGS. 1–3, the robot arm assembly 72 includes a robot arm 84 and an end effector 86 (see also FIGS. 5 and 6) connected to the robot arm 84 for being carried from station to station by same. More particularly, the robot arm 84 is similar to a conventional robot arm, such as a robot arm unit available from ADEPT TECHNOLOGY under the trademark ADEPT. For instance, the robot arm 84 includes a mounting spool 88 (see FIG. 1) secured to the floor of a facility in which the packaging machine 10 is installed. The robot arm 84 also includes a proximal arm 90*a*, which is pivotally mounted on the mounting spool 88, and a distal arm 90*b*, which is pivotally connected to the proximal arm 90*a* and which has a free end 92 opposite the proximal arm 90*a*. The distal arm 90*b* and the proximal arm 90*a* are servo-driven in such a manner that they are selectively and independently pivotable relative to the mounting spool 88 (as indicated by arrows B, C, respectively, in FIG. 1). A conventional pneumatic operating mechanism 94 (see FIG. 21), such as a valve and a rotary cylinder, is connected to a pressurized fluid source 96 (see FIG. 21), such as a pump, for a purpose to be discussed hereinafter.

In addition to the foregoing elements, the robot arm 84 is provided with a quill assembly 98 (see FIGS. 2 and 3) mounted to the free end 92 of the distal arm 90*b*. The quill assembly 98 is provided with a quill 98*a* having a lower end 102 (see FIGS. 2 and 5). The quill 98*a*, which is servo-driven in a conventional manner, is selectively movable in a vertical direction relative to the distal arm 90*b*. That is, the quill 98*a* is retractable and extendible from the quill assembly 98 in a direction parallel to the longitudinal axis of the quill assembly 98. The quill 98*a* is also selectively rotatable about its longitudinal axis within the quill assembly 98.

Figure 5:
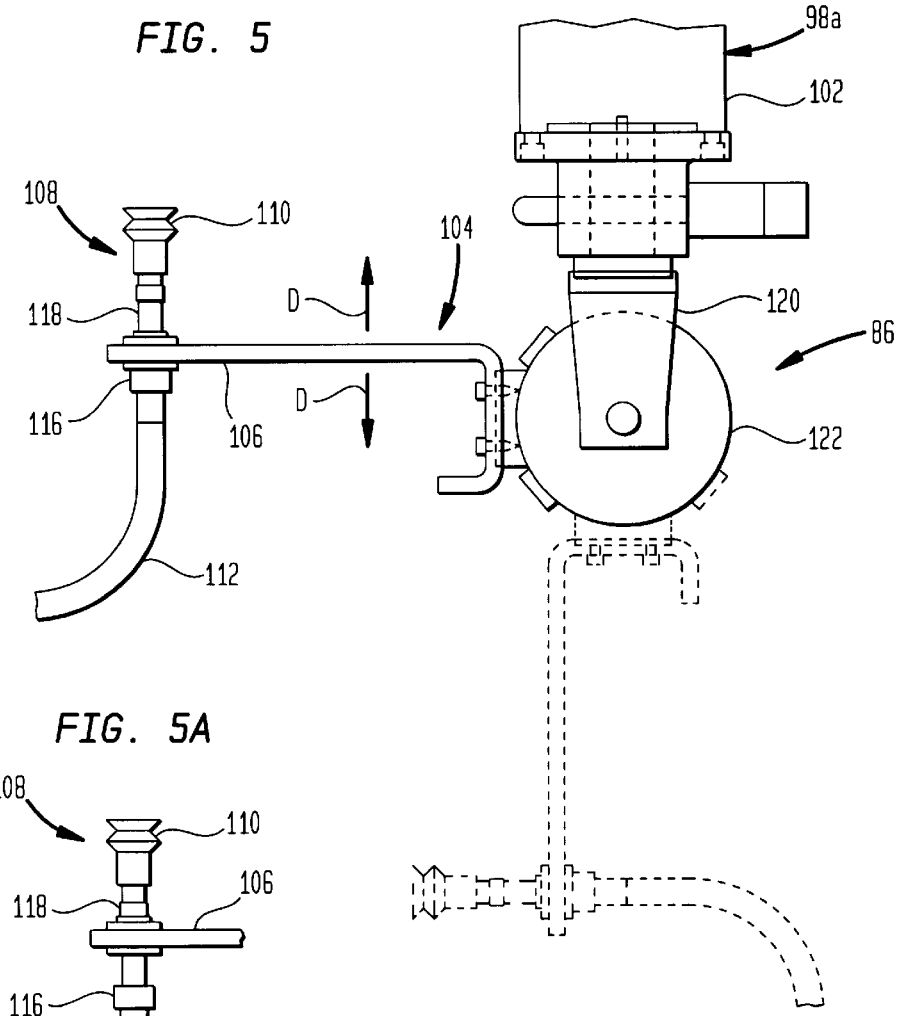
FIG. 5 is a side elevational view of an end effector of the packaging machine shown in FIGS. 1–3, suction units of the end effector being shown in their extended position.
Figure 6:
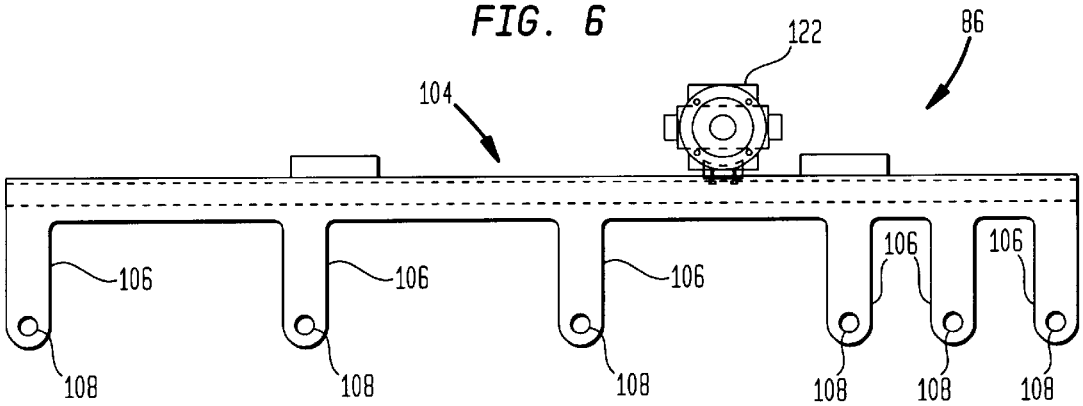
FIG. 6 is a top plan view of the end effector shown in FIG. 5.
Figure 7:
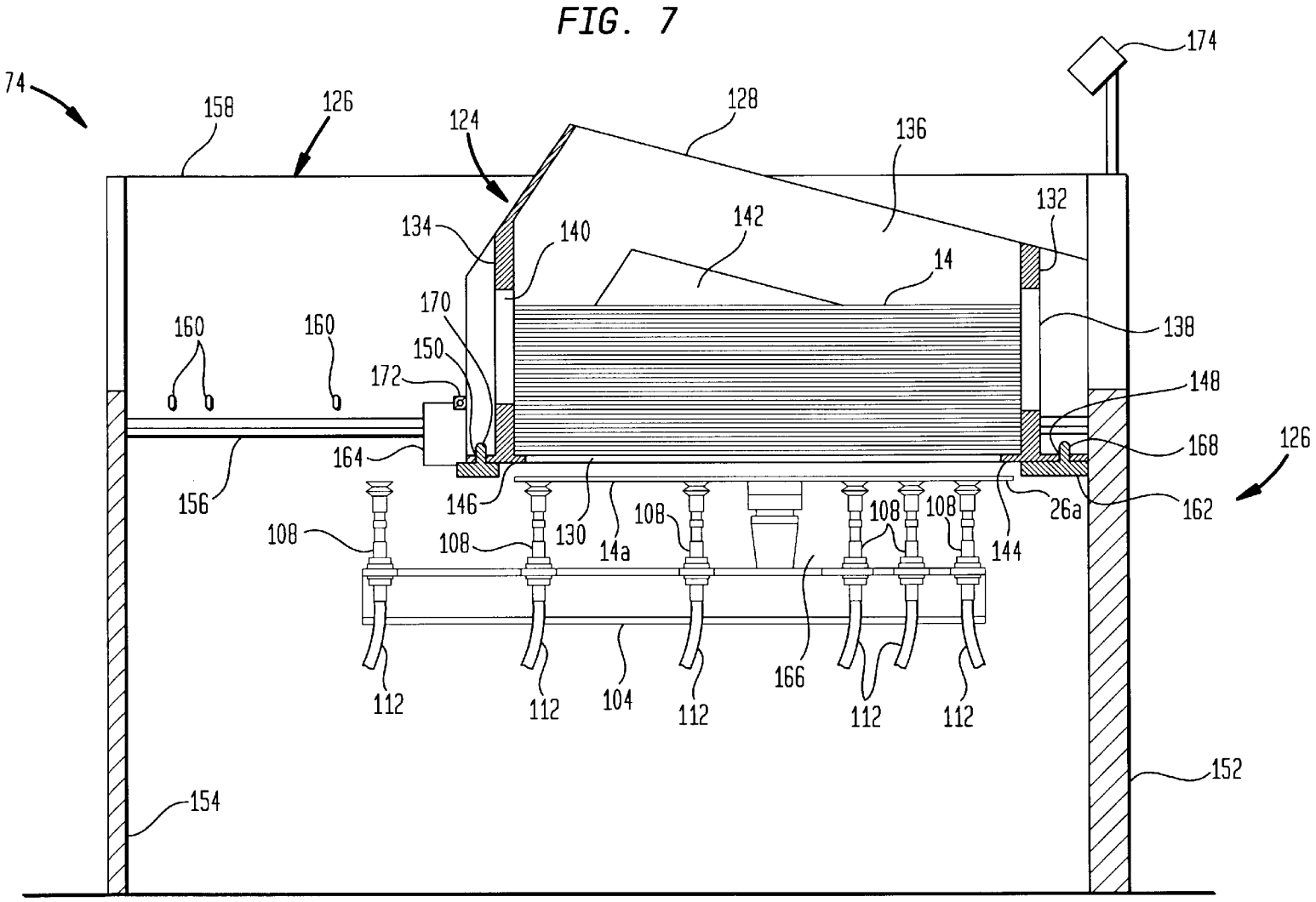
FIG. 7 is a side elevational view of a sealing station of the packaging machine shown in FIGS. 1–3.

Referring generally to FIGS. 1–3 and specifically to FIGS. 5–7, the end effector assembly 86 is secured to the lower end 102 of the quill 98*a*. The end effector assembly 86 includes an end effector 104, which is carried on (i.e., mounted to) the lower end 102 of the quill 98*a* and which is equipped with a plurality of legs 106 (see FIG. 6). Each of the legs 106 of the end effector 104 is provided with a suction unit 108 (see FIG. 7), each of which includes a suction cup 110 (see FIG. 5) at one end thereof and a tube 112 connected to an opposite end thereof for connecting the suction cup 110 to an end effector suction source 114 (see FIG. 21), such as a pump. The end effector suction source 114 is adapted to create suction (i.e., a low pressure condition) in the suction cups 110 and to thereby cause the suction cups 110 to grip an overwrap 14 and to carry (i.e., transport) same thereon from station to station as will be discussed further hereinafter.

Figure 5A:
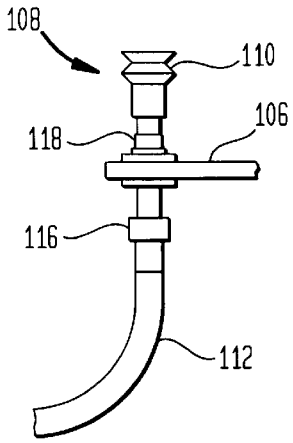
FIG. 5A is a side elevational view of suction units of the end effector shown in FIG. 5, the suction units being shown in their retracted position.

Each of the suction units 108, except for the one positioned closest to the front end 64 of the support top 62 (see FIG. 21), is also equipped with a valve 116 for selectively and independently controlling the suction unit 108 in a manual manner. That is, each of the valves 116 is adapted to be independently and selectively actuated between a closed position, in which the suction cup 110 is out of fluid communication with the end effector suction source 114 and is therefore non-operational, and an open position, in which the suction cup 110 is in fluid communication with the end effector suction source 114 and is therefore operational. In addition to the foregoing components, each of the suction units 108 is provided with a level compensator 118, which is similar to conventional level compensators such as the 33.50.068 level compensators marketed by PIAB, for allowing the suction units 108 to move vertically. More particularly, the level compensators 118 allow the suction units 108 to move between an extended position (see FIG. 5), in which the suction units 108 are fully extended upwardly and the suction cups 110 are remote from the end effector 104, and a depressed position (see FIG. 5A), in which the suction units 108 are depressed downwardly and the suction cups 110 are positioned adjacent to the end effector 104. The level compensators 118, which normally orient the suction units 108 in the extended position, allow the suction units 108 to adjust themselves as they come in contact with objects, such as an overwrap 14 during a picking stage.

Referring now to FIG. 5, the end effector assembly 86 is also provided with a rotator adaptor 120 connected to the lower end 102 of the quill 98*a* for conjoint vertical movement with same. A rotary cylinder 122 is rigidly connected to the end effector 104 and is rotatably mounted on the rotator adaptor 120. The rotary cylinder 122 is connected to the operating mechanism 94 so as to selectively rotate same and to thereby pivot the end effector 104 between an upper position (as indicated by the solid line representation of the end effector 104 in FIG. 5), in which the legs 106 of the end effector 104 are oriented horizontally and the suction cups 110 are positioned above the end effector 104, and a lower position (indicated by the broken line representation of the end effector 104 in FIG. 5), in which the legs 106 of the end effector 104 are oriented downwardly. In addition, because the rotary cylinder 122 and the rotator adaptor 120 connect the end effector 104 to the quill 98*a*, the end effector 104 is also adapted to move in a vertical direction (as indicated by arrows D in FIG. 5).

The Picking Station

Figure 8:
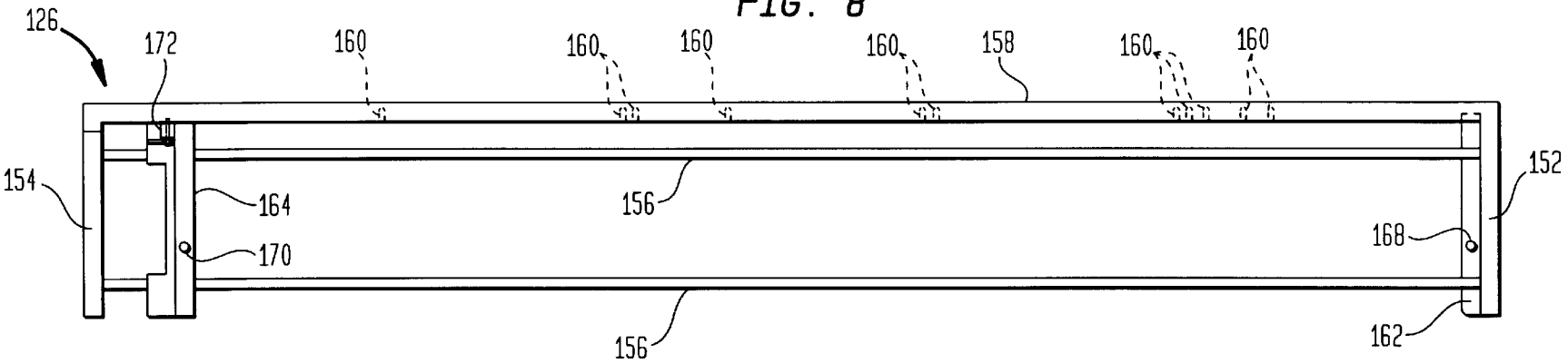
FIG. 8 is a top plan view of a tray holder assembly of the sealing station shown in FIG. 7.
Figure 9:
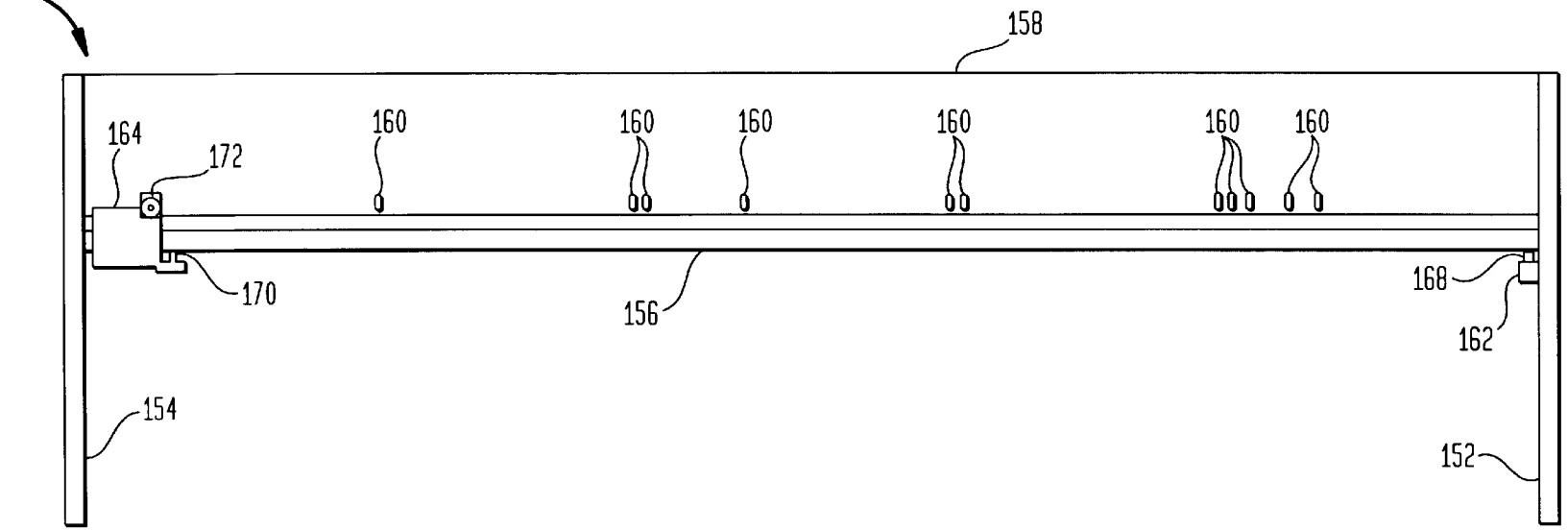
FIG. 9 is a side elevational view of the tray holder assembly shown in FIG. 8.

Referring generally to FIGS. 1–3 and specifically to FIGS. 7–9, the picking station 74, at which a stack of unsealed overwraps 14 is located for supplying the packaging machine 10 with same, includes a tray 124 and a tray holder assembly 126 for supporting the tray 124 thereon. The tray 124 is sized and shaped to receive and retain (i.e., contain) the stack of unsealed overwraps 14 therein and includes an open top end 128, an open bottom end 130, a front panel 132, a rear panel 134 and lateral panels 136 (see FIGS. 2 and 7).

The front, rear, and lateral panels 132, 134, 136 include openings 138, 140, 142, respectively, formed therein so as to facilitate the manual loading of the unsealed overwraps 14 in the tray 124 through the open top end 128. More particularly, the overwraps 14 are stacked in the tray 124 one on top of another with their opaque sheets 16 facing the open bottom end 130 and with their front (i.e., leading) ends 26 facing the front panel 132 of the tray 124. The rear panel 134 has a height which is greater than that of the front panel 132 for accommodating the folded (i.e., rear) ends 20 of the overwraps 14, which ends are positioned adjacent to the rear panel 134 in the tray 124. That is, because the flaps 28, 30 of the overwraps 14 are in a folded state (i.e., folded back onto the transparent sheets 18), the stack of overwraps 14 is thicker at the rear end thereof than at the front end thereof, and the higher rear panel 134 therefore accommodates the greater height of the rear end of the stack.

The tray 124 also includes a pair of ledges 144, 146 (see FIG. 7) formed at the open bottom end 130 and extending along the front panel 132 and rear panel 134, respectively. The ledges 144, 146 project towards each other (i.e., project inwardly towards the center of the bottom open end 130) for supporting the stack of overwraps 14 thereon in a nested manner, thereby retaining the stack of overwraps 14 in the tray 124. The ledges 144, 146 have holes 148, 150, respectively, formed therein for purposes to be discussed hereinafter.

With reference to FIGS. 7–9, the tray holder assembly 126 has a pair of support plates 152, 154 mounted on the support top 62 of the machine section 32 along the safety panel 50. More particularly, the support plates 152, 154 are positioned on the support top 62 adjacent the front end 64 and the rear end 66, respectively, of same (see FIG. 1). The tray holder assembly 126 also includes a pair of rails 156 (see FIG. 8), both of which extend between the support plates 152, 154, and a bracket plate 158 projecting vertically from the support plates 152, 154 and extending between same. Apertures 160 are formed along a lower edge of the bracket plate 158 for purposes to be discussed hereinafter.

In addition to the foregoing elements, the tray holder assembly 126 includes a stationary support member 162, which is immovably (i.e., rigidly) secured to the support plate 152, and a movable support member 164, which is movably mounted on the rails 156. More particularly, the movable support member 164 has openings (not shown) in opposite ends thereof for slidably receiving the rails 156 such that the movable support member 164 can be moved towards and away from the stationary support member 162. The stationary and movable support members 162, 164 cooperate with each other to support the tray 124 thereon in a nested manner such that the open bottom end 130 of the tray 124 is substantially unobstructed and is therefore accessible from an access area 166 (see FIG. 7) below the tray 124. The access area 166 is sized and shaped so as to accommodate the end effector 104 in an unobstructed manner for purposes to be discussed hereinafter.

The stationary and movable support members 162, 164 also include locating pins 168, 170, respectively, adapted for insertion into the holes 148, 150, respectively, of the ledges 144, 146, respectively, of the tray 124. In this manner, the tray 124 is securely and properly supported on the stationary and movable support members 162, 164. In addition, because the movable support member 164 is movable along the rails 156, the tray holder assembly 126 is adapted to accommodate trays having, for instance, different lengths (i.e., the distance between front and rear panels of the trays) by adjusting the position of the movable support member 164 relative to the stationary support member 162. In this regard, the movable support member 164 is provided with a spring plunger 172 adapted to be inserted into one of the apertures 160 of the bracket plate 158 corresponding to a desired location of the movable support member 164, thereby securing the movable support member 164 at such a location.

The picking station 74 also includes a sensor 174 (shown in FIGS. 3 and 7 but not shown in FIGS. 1 and 2), such as a conventional infra-red optical sensor, mounted from the support plate 152. The sensor 174 is adapted to overlook the stack of overwraps 14 in the tray 124 through the open top end 128 of the tray 124. The sensor 174 is connected to the controller 36 for sending a signal to same when the tray 124 is empty, thereby causing the controller 36 to signal an operator to refill the tray 124 with additional overwraps 14.

The Product Insertion Station

With initial reference to FIGS. 1–3, the product insertion station 76 is positioned in the machine section 32 adjacent to the safety panel 48 of the machine section 32 and adjacent to the picking station 74. An opening 176 (see FIGS. 1, 3, and 11A) is formed in the safety panel 48 for providing access to the picking station 74 from the operator section 34 for purposes to be discussed hereinafter.

Figure 10:
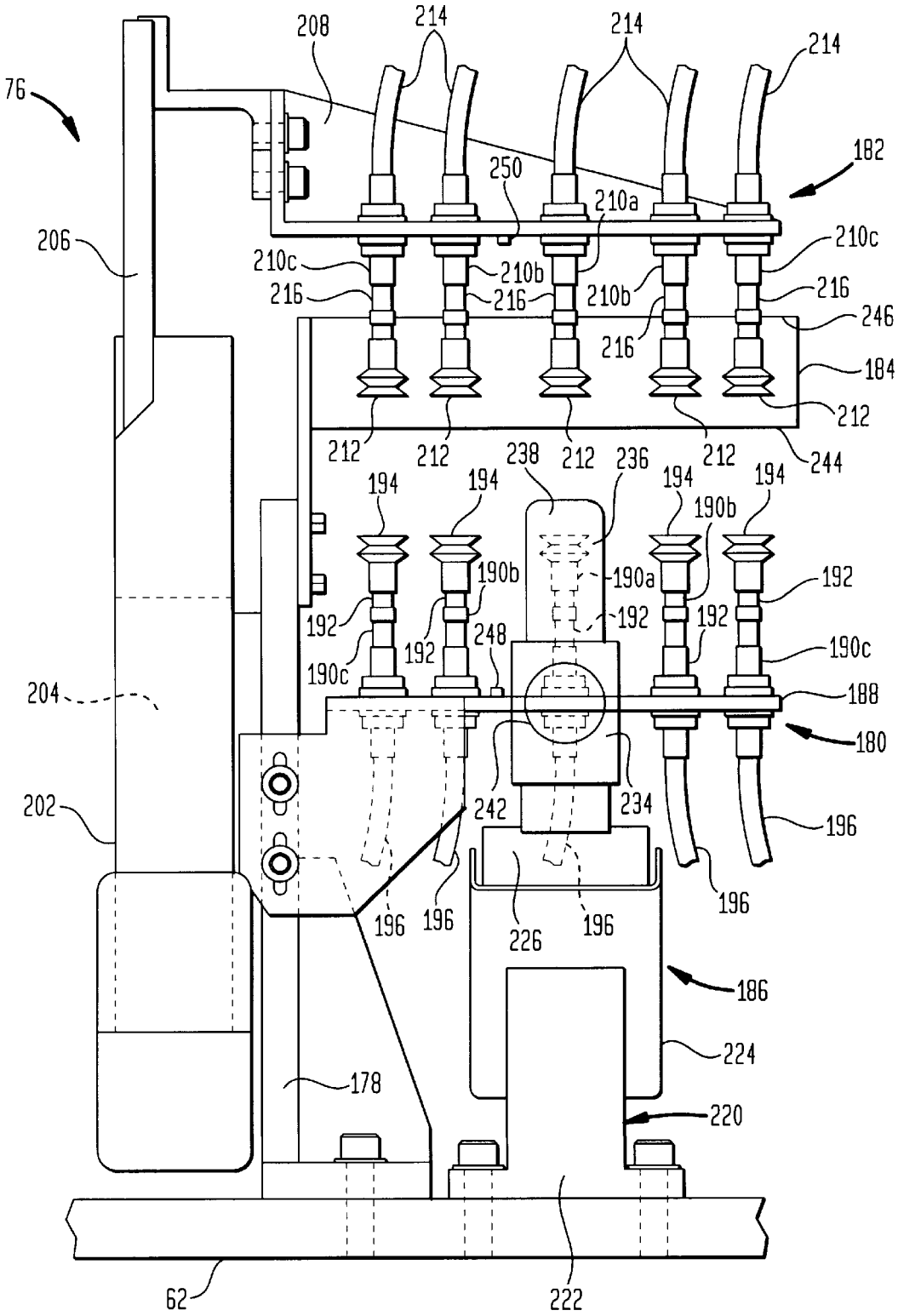
FIG. 10 is a front elevational view of a product insertion station of the packaging machine shown in FIGS. 1–3.
Figure 11A:
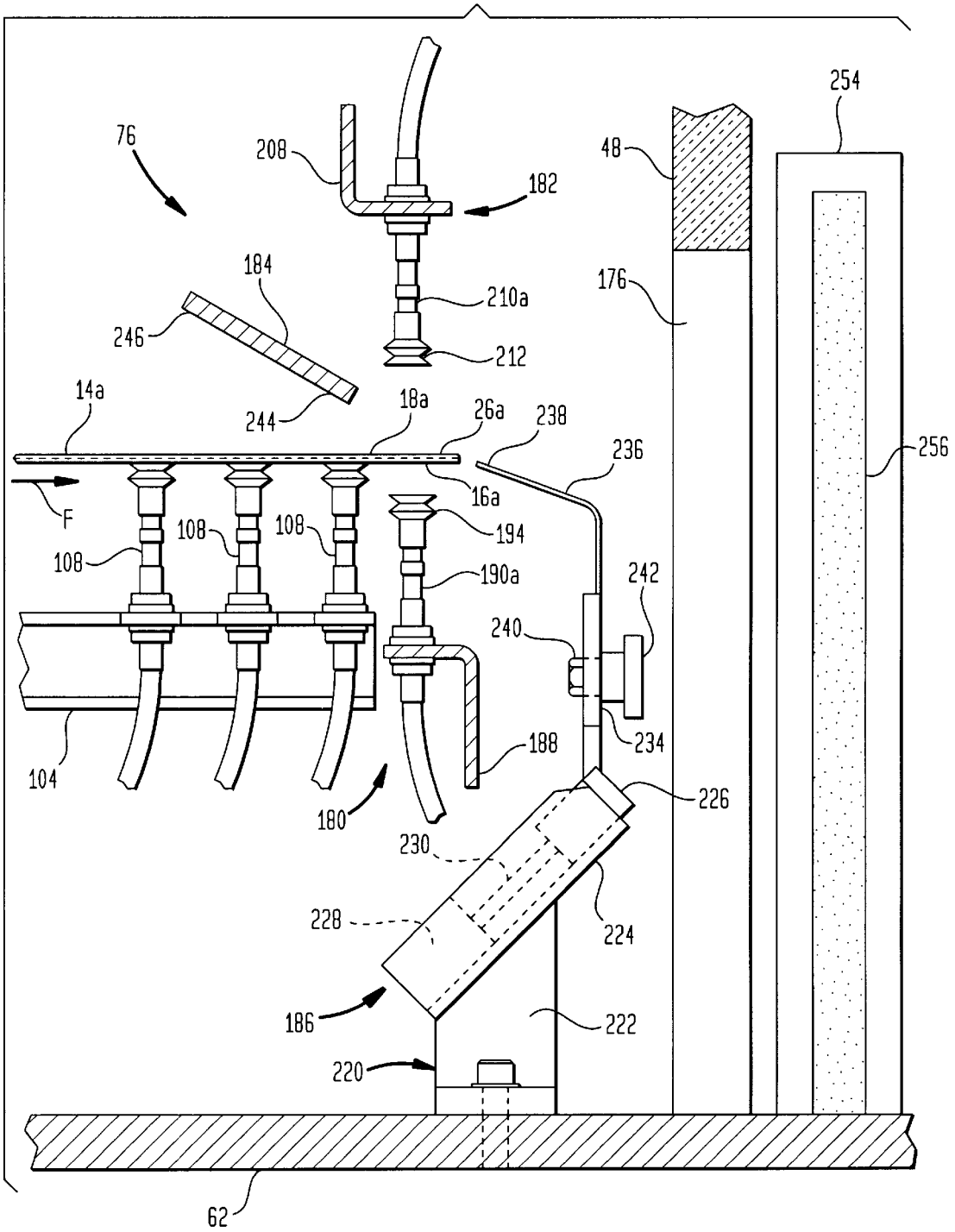
FIGS. 11A–11D are schematic views of the product insertion station shown in FIG. 10 during a product insertion stage of the operation of the packaging machine.

Referring now to FIGS. 10 and 11A, the product insertion station 76 includes a support plate 178 mounted on the support top 62 of the machine section 32. The product insertion station 76 also includes a lower opener assembly 180, an upper opener assembly 182, a lead-in member 184, and a package guard assembly 186.

The lower opener assembly 180, which is positioned adjacent to the opening 176 of the safety panel 48, is provided with a mounting bracket 188 rigidly attached to the support plate 178 in a removable manner. Suction units 190*a*, 190*b*, 190*c* are removably mounted on the mounting bracket 188 in a linear array and projecting upwardly from same. More particularly, the suction unit 190*a* is centrally located in the array, while the suction units 190*b* are positioned between the suction unit 190*a* and the suction units 190*c*, which are located at opposite ends of the array. The suction units 190*a*, 190*b*, 190*c* are substantially identical to the suction units 108 of the end effector 104 in construction and operation. Thus, each of the suction units 190*a*, 190*b*, 190*c* has a level compensator 192, a suction cup 194 at an upper end thereof, and a tube 196 at a lower end thereof. Unlike the suction units 108 of the end effector 104, the suction units 190*a*, 190*b*, 190*c* of the lower opener assembly 180 are not equipped with manual valves. Instead, the suction units 190*a*, 190*b*, 190*c* are directly connected to opener suction sources 198*a*, 198*b*, 198*c*, respectively (see FIG. 21). Accordingly, the suction units 190*a*, 190*b*, 190*c* are selectively and independently operated by programming the controller 36 to activate a predetermined one or ones of the opener suction sources 198*a*, 198*b*, 198*c*, respectively. Alternatively, the suction units 190*a*, 190*b*, 190*c* can be provided with manual valves similar to those of the suction units 108 of the end effector 104.

Still referring to FIGS. 10 and 11A, the upper opener assembly 182 is provided with a housing 202 supported from the support plate 178. An actuator 204, such as the SA-A4M-100 actuator available from KNOTTS, CO., is positioned in the housing 202, while a movable arm 206 is connected to the actuator 204 so as to be extended and retracted from the housing 202 in a vertical direction. A mounting bracket 208 is attached to the movable arm 206, while suction units 210*a*, 210*b*, 210*c* are removably mounted on the mounting bracket 208 in a linear array and projecting downwardly from same. More particularly, the suction unit 210*a* is centrally located in the array, while the suction units 210*b* are positioned between the suction unit 210*a* and the suction units 210*c*, which are located at opposite sides of the array. The suction units 210*a*, 210*b*, 210*c* are substantially identical to the suction units 190*a*, 190*b*, 190*c* of the lower opener assembly 180 in construction and operation. Thus, each of the suction units 210*a*, 210*b*, 210*c* has a suction cup 212 at a lower end thereof, a tube 214 at an opposite end thereof, and a level compensator 216. Like the suction units 190*a*, 190*b*, 190*c* of the lower opener assembly 180, the suction units 210*a*, 210*b*, 210*c* are directly connected to the opener suction sources 198*a*, 198*b*, 198*c*, respectively (see FIG. 21). Accordingly, the suction units 210*a*, 210*b*, 210*c* are selectively and independently operated by programming the controller 36 to activate a predetermined one or ones of the opener suction sources 198*a*, 198*b*, 198*c*, respectively.

For reasons which will be explained hereinafter, the suction units 210*a*, 190*a*, the suction units 210*b*, 190*b* and the suction units 210*c*, 190*c* are adapted to be operated conjointly. Thus, the suction units 210*a*, 210*b*, 210*c* are arranged on the mounting bracket 208 in a manner similar to that associated with the suction units 190*a*, 190*b*, 190*c* of the lower opener assembly 180 such that each of the suction cups 212 of the upper opener assembly 182 is in alignment with a corresponding one of the suction cups 194 of the lower opener assembly 180. Because the mounting bracket 208 is fixedly supported from the movable arm 206, the suction units 210*a*, 210*b*, 210*c* are vertically movable by selectively activating the actuator 204. That is, the suction units 210*a*, 210*b*, 210*c* of the upper opener assembly 182 are movable between an upper position, in which the suction cups 212 of the upper opener assembly 182 are spaced from the suction cups 194 of the lower opener assembly 180 (see FIGS. 10 and 11A), and a lower position, in which each of the suction cups 212 of the upper opener assembly 182 is in abutment with a corresponding one of the suction cups 194 of the lower opener assembly 180 (see FIG. 11B).

Figure 11B:
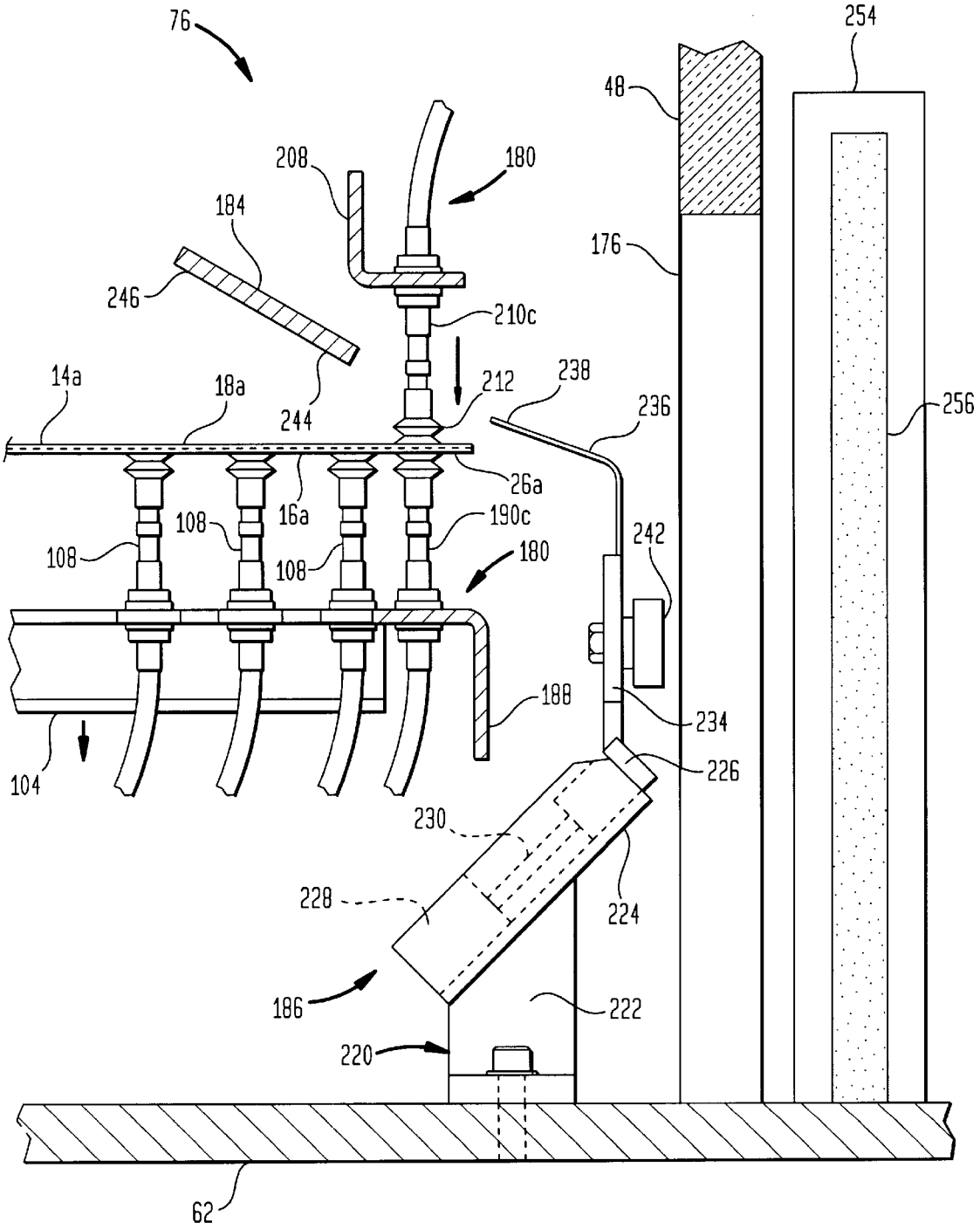

With reference to FIGS. 10 and 11B, the package guard assembly 186 is mounted on the support top 62 of the machine section 32 between the lower opener assembly 180 and the opening 176 formed in the safety panel 48. More particularly, the package guard assembly 186 is provided with a slide holder 220 having a base 222, which is mounted on the support top 62 of the machine section 32, and a U-shaped shield 224 integrally formed on the base 222 and being inclined with respect to the support top 62. A slide 226 is movably supported on the U-shaped shield 224, while an air piston unit 228 is secured on the U-shaped shield 224 at a lower end of same. The piston unit 228 is provided with a piston 230 which is connected to the slide 226. A piston unit control valve 232 (see FIG. 21) is connected to the piston unit 228 and to the pressurized fluid source 96 for moving the piston 230 and therefore the slide 226 along the U-shaped shield 224. A tongue holder 234 projects vertically from the slide 226 for conjoint movement with same, while a tongue 236 is attached to the tongue holder 234 and has an a free end 238 angled relative to the tongue holder 234 for purposes to be discussed hereinafter. A screw 240 removably secures the tongue 236 to the tongue holder 234, whereby the tongue 236 is replaceable with another tongue to accommodate different sizes of overwraps (e.g., those having different widths). The screw 240 has a screw knob 242 positioned on a side of the tongue holder 234 adjacent the opening 176 formed in the safety panel 48, thereby facilitating access to the screw knob 242 and hence the removal and/or replacement of the tongue 236.

The lead-in member 184, which is mounted to the support plate 178 of the product insertion station 76, includes a front end 244 and a rear end 246. The lead-in member 184 is inclined relative to the horizontal (i.e., the front end 244 is positioned at an elevation lower than that of the rear end 246). Moreover, the front end 244 terminates at a point behind the lower and upper opener assemblies 180, 182 so as not to interfere with the movement of the suction units 210*a*, 201*b*, 210*c* of the upper opener assembly 182 in relation to the lower opener assembly 180. Further, for purposes to be discussed hereinafter, the front end 244 of the lead-in member 184 is positioned at an elevation between the elevation of the suction cups 212 of the upper opener assembly 182 when they are at their upper position and the elevation of the suction cups 194 of the lower opener assembly 180.

The product insertion station 76 is also provided with optical sensors 248, 250 (see FIG. 10) which are mounted on the mounting brackets 188, 208, respectively, of the lower and upper opener assemblies 180, 182, respectively. The function of the optical sensors 248, 250 will be discussed hereinafter.

Referring to FIGS. 1–3 and 11A–11D, the product insertion station 76 also includes a safety mechanism. More particularly, an infra-red light sensor unit 252 is positioned in the operator section 34 on one side of the opening 176 formed in the safety panel 48, while a complementary infra-red light sensor unit 254 is positioned in the operator 34 section on the other side of the opening 176 (see FIGS. 1 and 2). The sensor units 252, 254 cooperate to form a light curtain 256 (see FIGS. 11A–11D) immediately in front of the opening 176 of the safety panel 48. As a result, the light curtain 256 covers the opening 176 for safety reasons which will be discussed further below. Moreover, switches 258 (see FIGS. 1 and 2), such as infra-red light switches or touch-sensitive switches, are mounted on the table top 42 of the operator section 34 and are connected to the controller 36. In addition, a traffic light panel 260 (see FIG. 3) is mounted adjacent the safety panel 48 where it can be readily seen by an operator. More particularly, the light panel 260 includes a red light 262 and a green light 264, both of which are selectively turned on and off by the controller 36.

The Inspection Station

With reference to FIGS. 1–3, the inspection station 78 is placed adjacent to the product insertion station 76 and the picking station 74. The inspection station 78 includes a back-light 268, which is mounted on the support top 62 of the machine section 32, and a camera 270 mounted directly above the back-light 268. A mounting pole 272 is supported from the upper end of the sealing station 80 in such a manner that it does not interfere with the movement of the robot arm assembly 72 (see FIGS. 2 and 3). A fine positioning bracket 274 (see FIGS. 2 and 3) extends from a top end of the mounting pole 272 and is connected to the camera 270. The fine positioning bracket 274 is adjustable in three directions (i.e., along the X, Y and Z axes) for positioning the camera 270 in proper relation to the back-light 268.

The Sealing Station

Figure 14:
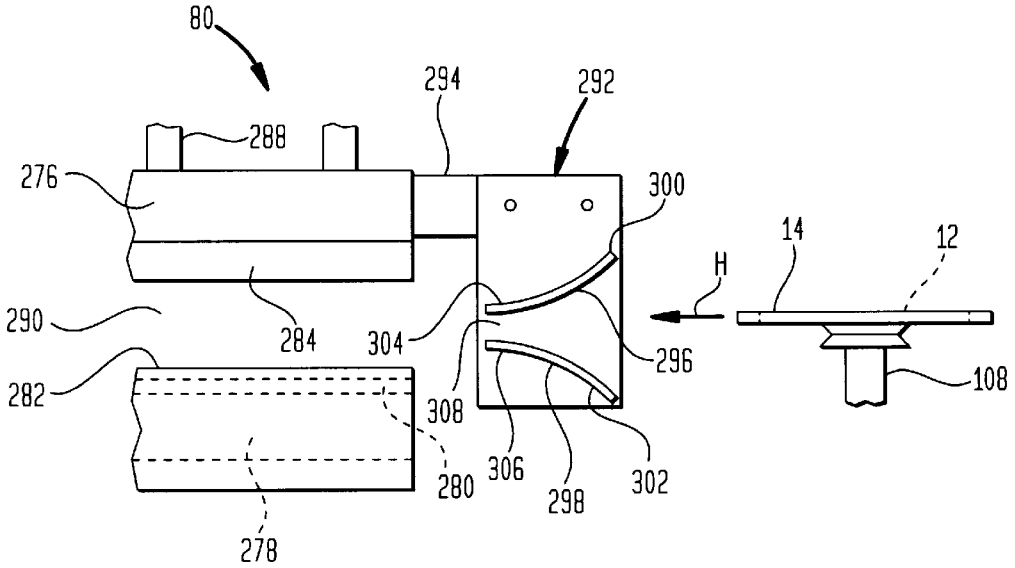
FIG. 14 is a side elevational view of a sealing station of the packaging machine shown in FIGS. 1–3 prior to the positioning of a stuffed overwrap therein.

Referring to FIGS. 1 and 2, the sealing station 80 is mounted on the support top 62 of the machine section 32 between the back-light 268 of the inspection station 78 and the mounting spool 88 of the robot arm 84. With specific reference to FIGS. 14 and 15, the sealing station 80 is provided with a movable upper plate 276 and a stationary lower plate 278. The lower plate 278, which is mounted on the support top 62, includes a rubber seal die 280, which is placed on an upper side of the lower plate 278 adjacent the upper plate 276, and a flouroglass sheet 282 covering the rubber seal die 280 as is done conventionally in the heat sealing art. The upper plate 276 includes a heating die 284 adapted to be heated to a temperature sufficient for sealing the leading (i.e., front) end of an overwrap 14. An air cylinder device 286 (see FIG. 2) is suspended above the upper plate 276 and is provided with a piston 288 attached to the upper plate 276 for moving same between a lower position, in which the heating die 284 of the upper plate 276 is depressed against the rubber seal die 280 of the lower plate 278, and an upper position, in which the heating die 284 of the upper plate 276 is spaced from the rubber seal die 280 of the bottom plate 278. When the upper plate 276 is in its upper position, the heating die 284 and the rubber seal die 280 cooperate to form a space 290 (see FIG. 14) therebetween.

The sealing station 80 also includes a lead-in plate 292 provided with a mounting bracket 294 for mounting the lead-in plate 292 to the upper plate 276 between the backlight 268 of the inspection station 78 and the upper plate 276 of the sealing station 80. More particularly, the lead-in plate 292 includes an upper member 296 and a lower member 298 spaced from the upper member 296. The upper member 296 and the lower member 298 have diverging ends 300, 302, respectively, opposite the upper and lower plates 276, 278 of the sealing station 80 and converging ends 304, 306, respectively, adjacent the upper and lower plates 276, 278. The diverging ends 300, 302 are spaced apart at a distance greater than the distance between the converging ends 304, 306. The converging ends 304, 306 form a narrow channel 308 directed towards the space 290 formed between the heating die 284 of the upper plate 276 and the rubber seal die 280 of the lower plate 278 when the upper plate 276 is in its upper position for purposes to be discussed hereinafter.

The Product Ejection Station

With reference to FIGS. 1, 2, 16 and 17, the product ejection station 82 includes a support assembly 310, a slide assembly 312, which is mounted from the support assembly 310, a chute assembly 314 and an ejector 316 supported from the slide assembly 310. The support assembly 310 includes a pair of support panels 318, 320 depending from the support top 62 of the machine section 32. The support panels 318, 320 are arranged along the channel 68 formed in the support top 62. More particularly, the support panel 318 is positioned adjacent the front end 64 of the support top 62, while the support panel 320 is positioned adjacent the rear end 66 of the support top 62 (see FIG. 1). Rails 322 extend between the support panels 318, 320 for purposes to be discussed hereinafter.

Figure 16:
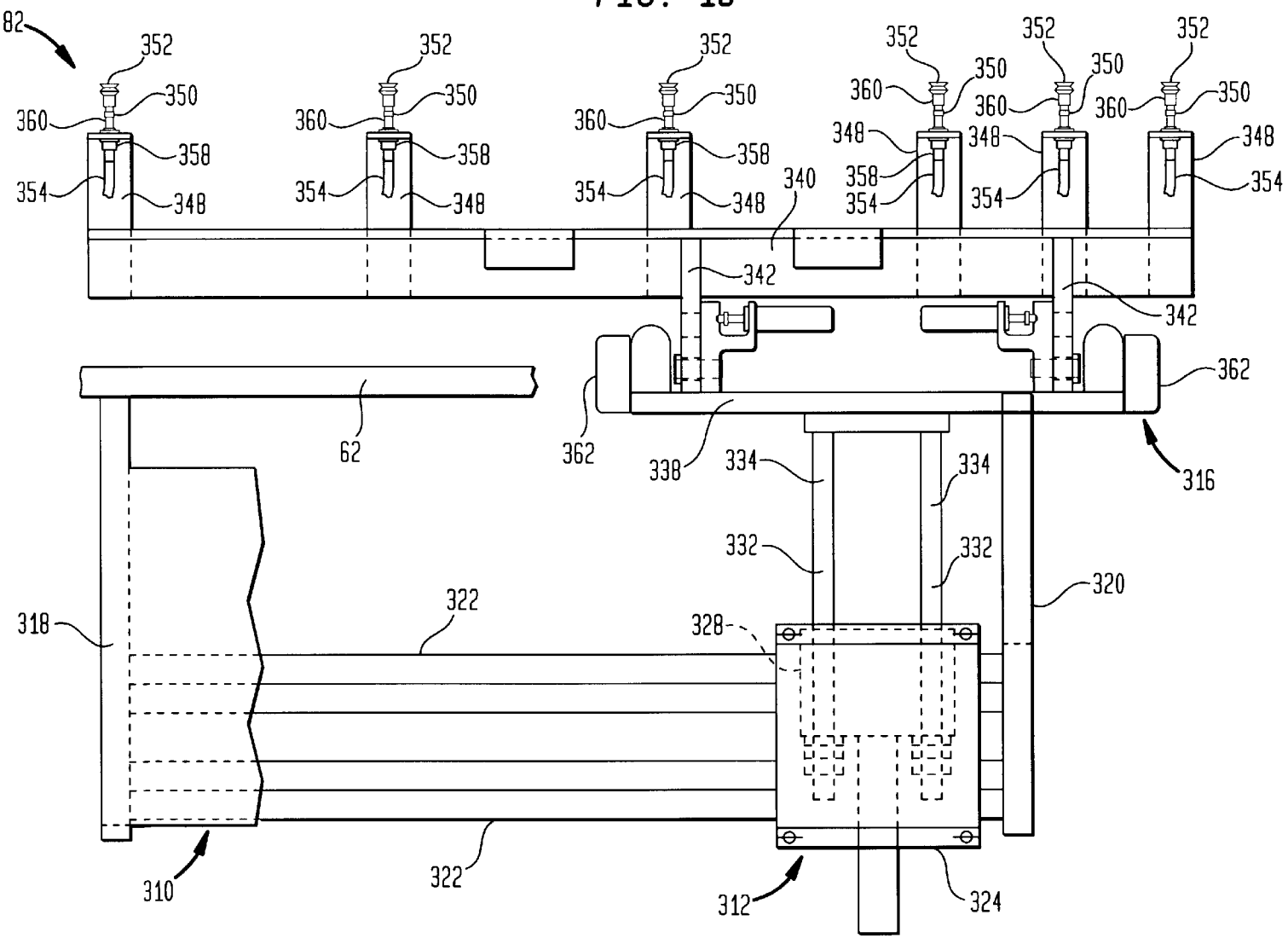
FIG. 16 is a side elevational view of an ejector station of the packaging machine shown in FIGS. 1–3.
Figure 17:
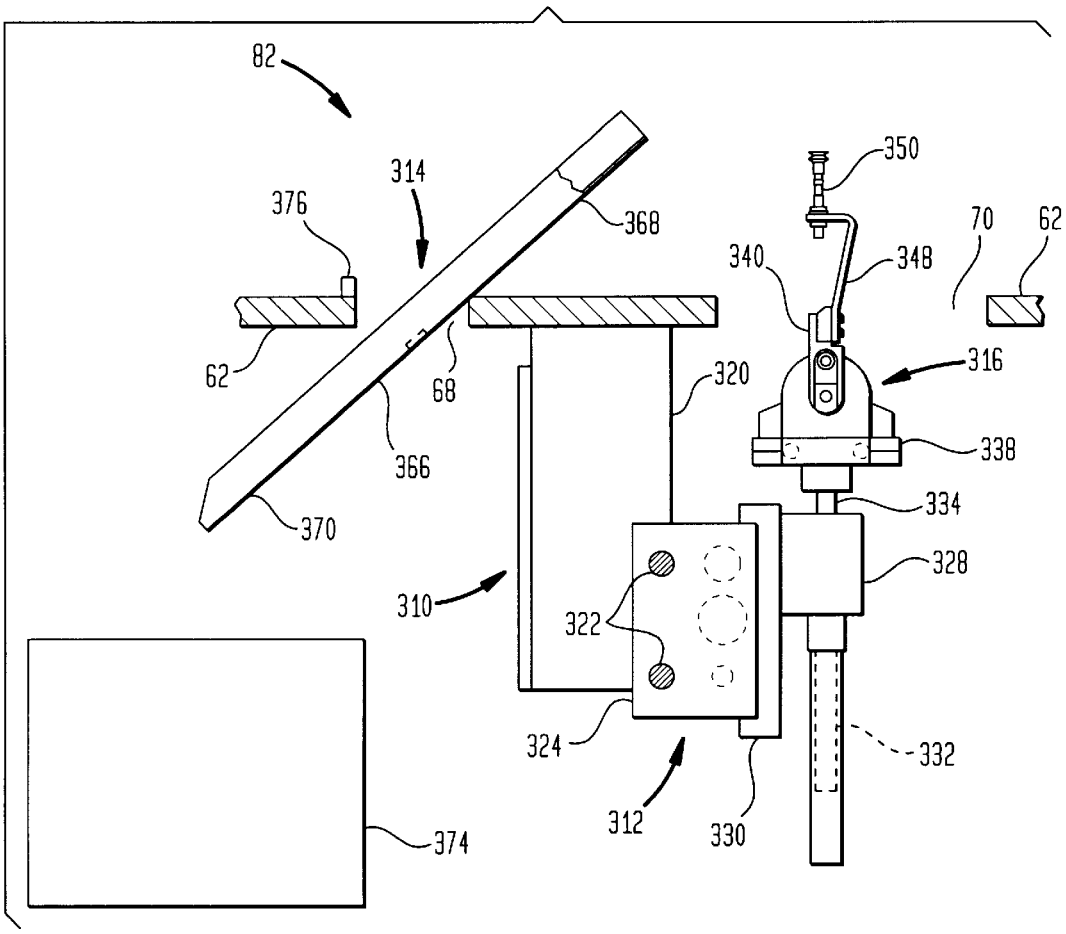
FIG. 17 is a front elevational view of the ejector station shown in FIG. 16.

Referring to FIGS. 2, 16 and 17, the slide assembly 312 is provided with a slide 324, such as the CBU061X19-Q slide available from PHD, movably mounted on the rails 322. A slide control valve 326 connects the slide 324 to the pressurized fluid source 96 for selectively supplying the slide 324 with pressurized fluid to move the slide 324 on the rails 322 between the support panels 318, 320. The slide assembly 312 also includes a thruster 328, such as the TE-095-EB2-M thruster available from BIMBA, and an adapter plate 330 (see FIG. 17) for attaching the thruster 328 to the slide 324. The thruster 328 is provided with a pair of rods 332 extendable and retractable therefrom and having upper ends 334. A thruster control valve 336 (see FIG. 21) connects the thruster 328 to the pressurized fluid source 96 for selectively controlling the movement of the rods 332.

Figure 18:
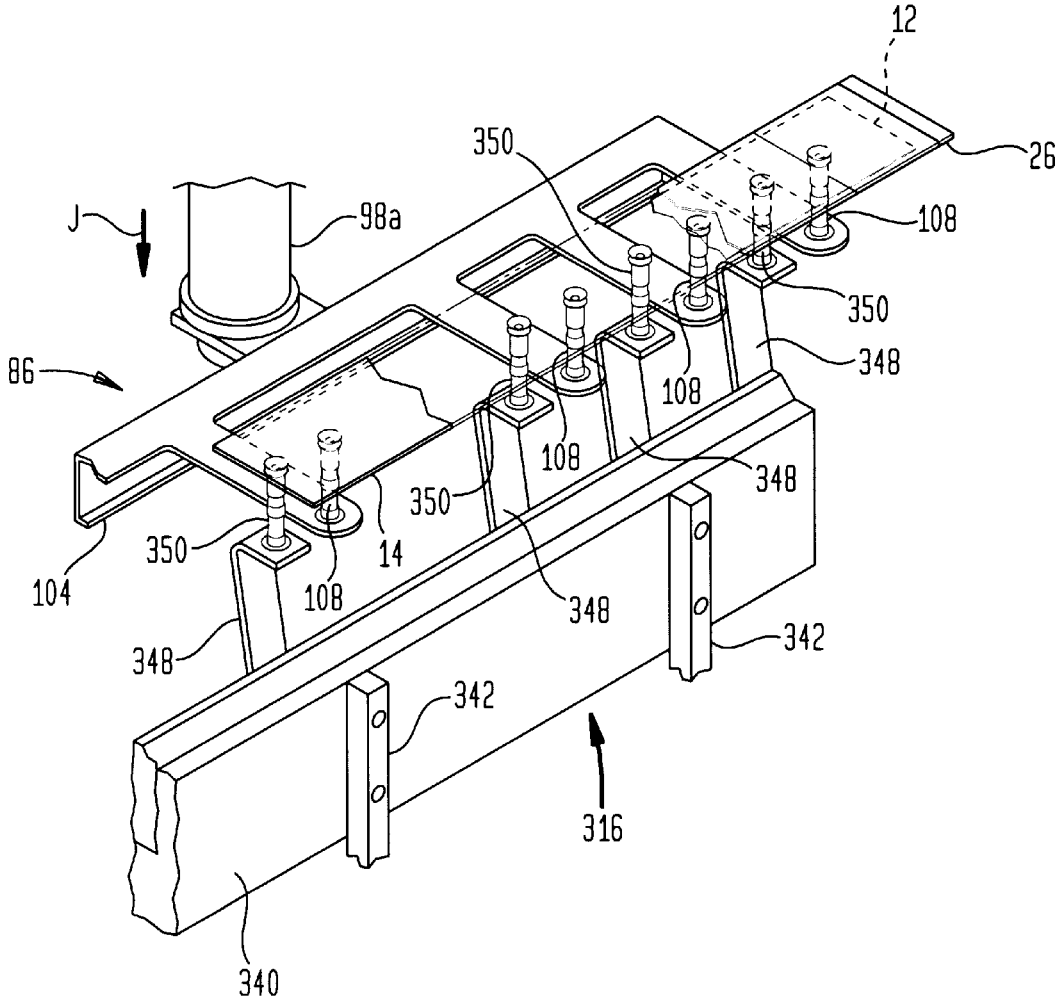
FIG. 18 is a schematic view of an ejector of the ejector station shown in FIG. 17.
Figure 19:
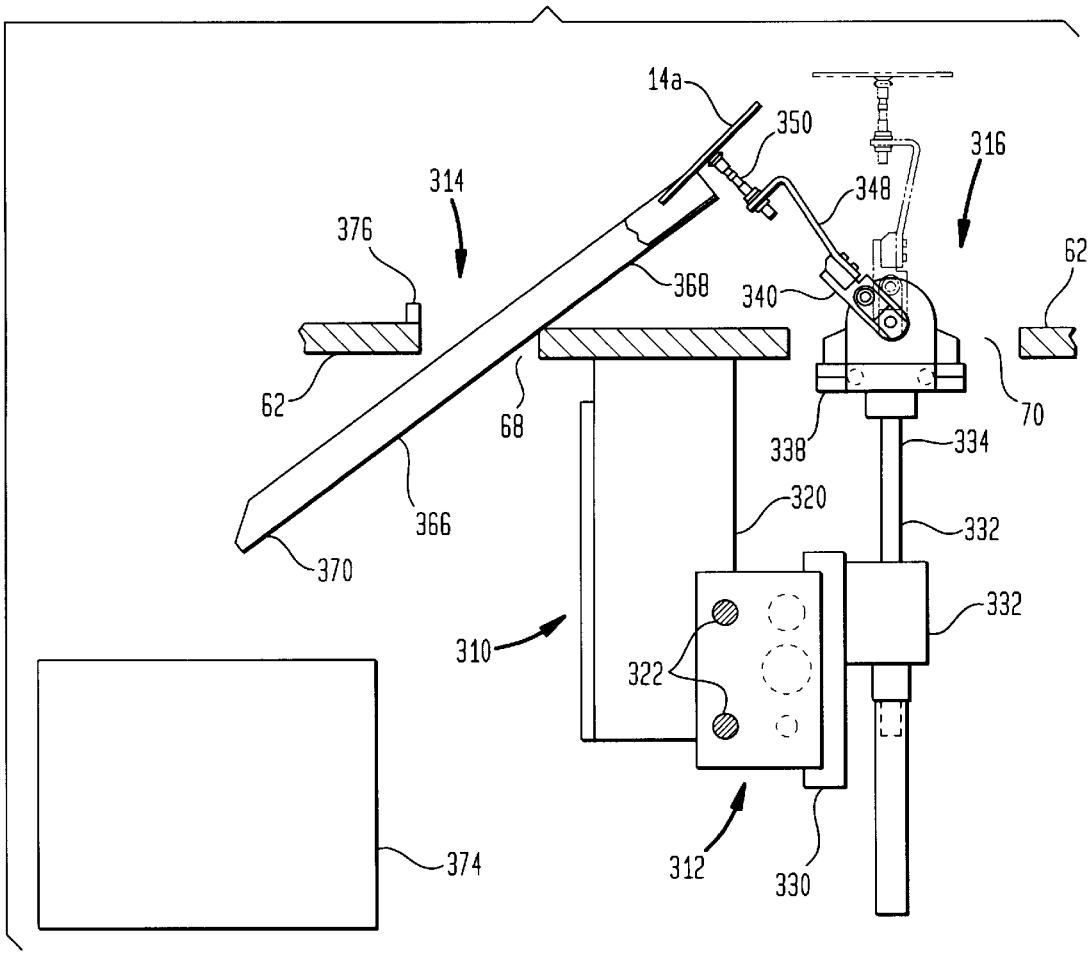
FIG. 19 is a schematic view of the ejector station shown in FIG. 17.

Referring now to FIGS. 16–18, the ejector 316 is provided with a rotary cylinder holder 338, which is mounted at the upper ends 334 of the rods 332 of the thruster 328, thereby mounting the ejector 316 on the slide 324. More particularly, the ejector 316 is mounted on the rods 332 such that it is positioned in the channel 70 formed in the support top 62 (see FIGS. 1, 17 and 19). Because the rods 332 are vertically movable, the ejector 316 is vertically movable between a lower position (see FIG. 17), in which the ejector 316 is positioned proximate to the slide 324, and an upper position (see FIG. 19), in which the ejector 316 is positioned remote from the slide 324 in the channel 70. Because the ejector 316 is mounted on the slide 324, it is also movable along the channel 70 between a front position (see FIG. 1), in which the ejector 316 is positioned adjacent to the sealing station 80, and a rear position, in which the ejector 316 is positioned remote from the sealing station 80 (see FIG. 20).

In addition to the foregoing elements, the ejector 316 includes a holder bar 340 supported on the rotary cylinder holder 338, as well as inserts 342 pivotally connecting the holder bar 340 to the rotary cylinder holder 338. Legs 348 extend from the holder bar 340 away from the rotary cylinder holder 338. The legs 348 are spaced apart from each other in a manner similar to that associated with the legs 106 of the end effector 104 for purposes to be discussed hereinafter. Suction units 350, which are substantially identical to the suction units 108 of the end effector 104 in construction and operation, are provided on the legs 348 of the ejector 316 such that each of the legs 348 supports a corresponding one of the suction units 350. Each of the suction units 350 has a suction cup 352 at one end thereof and a tube 354 connected to an opposite end thereof for connecting the suction cup 352 to an ejector suction source 356 (see FIG. 21), such as a pump. In addition, each of the suction units 350, except for the pair positioned closest to the sealing station 80 (see FIG. 21), is equipped with a valve 358 for manually controlling same, as well as a level compensator 360.

The ejector 316 is also provided with a pair of rotary cylinders 362 at opposite ends of the rotary cylinder holder 338. The rotary cylinders 362 are connected to ejector control valves 364. The ejector control valves 364 are coupled to the pressurized fluid source 96 for selectively pivoting the ejector 316 between an upright position (as indicated by the broken line representation of the ejector 316 in FIG. 19), in which the suction units 350 are oriented vertically, and a tilted position (as indicated by the solid line representation of the ejector 316 in FIG. 19), in which the suction units 350 are tilted relative to the vertical, for purposes to be discussed hereinafter.

The chute assembly 314 is provided with an ejector chute 366 extending from the interior of the machine section 32 to the exterior of same through the channel 68 formed in the support top 62. More particularly, the ejector chute 366 is provided with an upper portion 368, which extends upwardly from the support top 62 at an angle, and a lower portion 370, which extends downwardly from the support top 62 at a similar angle. In other words, the ejector chute 62 is titled such that an object placed on the upper portion 368 of the ejector chute 366 slides towards the lower portion 370 by gravitational force acting upon the object. The ejector chute 366 is also provided with a plurality of cutouts 372 (see FIG. 1) in an upper edge thereof. The cutouts 372 are spaced apart from each other in a manner similar to the manner in which the legs 348 of the ejector 316 are spaced from each other. A collection bin 374 is also placed below the lower portion 370 of ejector chute 366, while an infra-red light sensor 376 is mounted from the support top 62 adjacent the front end of the ejector chute 366 (i.e., the end adjacent the front end of the support top 64). The infra-red light sensor 376 is connected to the controller 36 for purposes to be discussed hereinafter.

The Operation of the Present Invention

With reference to FIGS. 3 and 7, after the overwraps 14 are loaded in the tray 124 in the manner described above, the movable support member 164 of the tray holder assembly 126 is moved to a desired location along the rails 156 and is then secured in such a location by inserting the spring plunger 172 into a corresponding one of the apertures 160 of the bracket plate 158. The tray 124 is then mounted on the stationary and movable support members 162, 164. In addition, the valves 116 of the suction units 108 of the end effector 104 and the valves 358 of the suction units 350 of the ejector 316 are selectively actuated in accordance with the size (i.e., the length) of the overwraps 14. Moreover, the controller 36 is programmed with predetermined instructions so as to activate a selected one or ones of the opener suction sources 198*a*–198*c* during the product insertion stage of the packaging operation.

When an operator activates the "start" switch 46 on the control panel 44, the packaging machine 10 commences its initial stage of operation (i.e., the picking stage). Accordingly, the controller 36 causes the robot arm 84 to be actuated so as to position the end effector 104 in the access area 166 located directly below the tray 124 (see FIGS. 1–3 and 7). More particularly, with the end effector 104 oriented in its upper position (as indicated by the solid line representation of the end effector 104 in FIG. 5), the controller 36 activates the robot arm assembly 72 so as to selectively pivot the proximal arm 90*b* and the distal arm 90*a* to a predetermined robot arm position (as indicated by the broken line representation E of the robot arm 84 in FIG. 20). The suction units 108 of the end effector 104 are thus positioned in proper relation (i.e., aligned) with the bottom end 130 of the tray 124 (see FIGS. 2, 3, and 7).

Next, the controller 36 activates the quill assembly 98 and causes the quill 98*a* to retract into the quill assembly 98, moving the end effector 104 upwardly towards the tray 124 until the suction cups 110 of the end effector 104 are positioned in a preselected pick-up position (i.e., until the suction cups 110 come in contact with a lowermost one 14*a* of the overwraps 14 loaded in the tray 124). The controller 36 then activates the end effector suction source 114, causing the suction cups 110 of the end effector 104 to grip the lowermost overwrap 14*a*.

After the activation of the end effector suction source 114 by the controller 36, the quill assembly 98 is activated to cause the quill 98*a* to be extended therefrom, moving the end effector 104 downwardly away from the tray 124 and causing the overwrap 14*a* to be removed from the tray 124 (see FIGS. 3 and 7) through the open bottom end 130 thereof. In this manner, the overwrap 14*a* is placed on the suction cups 110 of the end effector 104 in a predetermined orientation. That is, the overwrap 14*a* is positioned on the suction cups 110 of the end effector 104 such that the leading (i.e., front) end 26*a* of the overwrap 14*a* extends beyond the front suction cup 108 of the end effector 104 (i.e., the suction cup positioned adjacent the support plate 152 of the tray holder assembly 126).

After the completion of the picking stage, the packaging machine 10 enters the product insertion stage of the packaging operation. Accordingly, the robot arm assembly 72 is actuated so as to move (i.e., transport) the end effector 104, and thus the overwrap 14*a* carried thereby, towards the product insertion station (as indicated by arrow F in FIG. 11A). More particularly, with the suction units 210*a*–210*c* of the upper opener assembly 182 positioned in their upper position (see FIG. 11A), the proximate and distal arms 90*a*, 90*b* of the robot arm assembly 72 move into another predetermined robot arm position (as indicated by the broken line representation G of the robot arm 84 in FIG. 20) and place the end effector 104 in a predetermined product insertion position, in which the end effector 104 is positioned adjacent to the lower opener assembly 180 and the suction cups 110 of the end effector 104 are positioned at an elevation between the elevations of the suction cups 194, 212 of the lower and upper assemblies 180, 182, respectively (see FIG. 11A).

In the product insertion position of the end effector 104, the leading end 26*a* of the overwrap 14*a* is placed between the suction cups 194, 212 of the lower and upper opener assemblies 180, 182, respectively, and is in alignment with same (see FIG. 11A). In this regard, the lead-in member 184 guides the leading edge 26*a* of the overwrap 14*a* so as to ensure that the leading end 26*a* is positioned in proper relation to the suction cups 194, 212 of the lower and upper opener assemblies 180, 182, respectively. For instance, in the event that the leading end 26*a* of the overwrap 14*a* is curled upwardly, the lead-in member 184 flattens the curled leading end 26*a*, preventing same from hitting the upper opener assembly 182 and from being misguided.

When the leading end 26*a* of the overwrap 14*a* is placed between the suction cups 194, 212 of the lower and upper opener assemblies 180, 182, respectively, it triggers the sensors 248, 250 so as to signal the controller 36 to continue the product insertion stage of the packaging operation. In the event that the sensors 248, 250 are not triggered, the controller 36 activates the robot arm assembly 72 so as to return the end effector 104 to the picking station 74 to pick up another overwrap.

When the sensors 248, 250 are triggered, the controller 36 activates the quill assembly 98 so as to move the suction cups 110 of the end effector 104 downwardly so as to position same in alignment with the suction cups 194 of their lower opener assembly 180. The controller 36 also causes the actuator 204 to move the suction units 210*a*–210*c* of the upper opener assembly 182 from their upper position (see FIG. 11A) to their lower position (see FIG. 11B).

Thereafter, the controller 36 causes the preselected one or ones of the opener suction sources 198*a*–198*c* to be activated. As a result, a corresponding one or ones of the suction cups 194 of the lower opener assembly 180 grips the semi-opaque sheet 16*a* of the overwrap 14*a* at the leading end 26*a* thereof, while a corresponding one or ones of the suction cups 212 of the upper opener assembly 182 grips the transparent sheet 18*a* of the overwrap 14*a* (see FIG. 11B). The actuator 204 is then activated so as to move the suction units 210*a*–210*c* of the upper opener assembly 182 from their lower position to an intermediate position (i.e., a position between their upper and lower positions), thereby causing the leading end 26*a* of the overwrap 14*a* to open for receiving associated contents 14*a* (see FIG. 11C).

Next, the controller 36 activates the piston unit control valve 232 so as to cause the piston 230 of the package guard assembly 186 to move downwardly. As a result, the tongue 236 is moved from its upper position (see FIG. 11B), in which the free end 238 of the tongue 236 is out of contact with the leading end 26*a* of the overwrap 14*a*, to its lower position (see FIG. 11C), in which the free end 238 of the tongue 236 depresses the semi-opaque sheet 16*a* of the overwrap 14*a* at the leading end 26*a*. At this time, the movement of all of the mechanical components of the packaging machine 10 is frozen for safety purposes.

Upon freezing the movement of all of the mechanical components of the packaging machine 10, the controller 36 bypasses or disables the infra-red light sensor units 252, 254, which normally send a signal to the controller 36 to shut off the packaging machine 10 when the light curtain 256 formed by the infra-red light sensor units 252, 254 is triggered by an operator's hand and/or a foreign object inserted into the machine section 32 through the opening 176 of the safety panel 48 as will be discussed in greater detail hereinafter. In this manner, the controller 36 permits the operator stationed in the operator section 34 to insert the contents 12*a* into the overwrap 14*a* without causing the packaging machine 10 to shut off. As a result, the controller 36 causes the light panel 260 to turn off the red light 262, which is normally turned on during the operation of the packaging machine 10, and to then turn on the green light 264, indicating to the operator to insert (i.e., load) the contents 12*a* into the overwrap 14*a*.

Figure 11C:
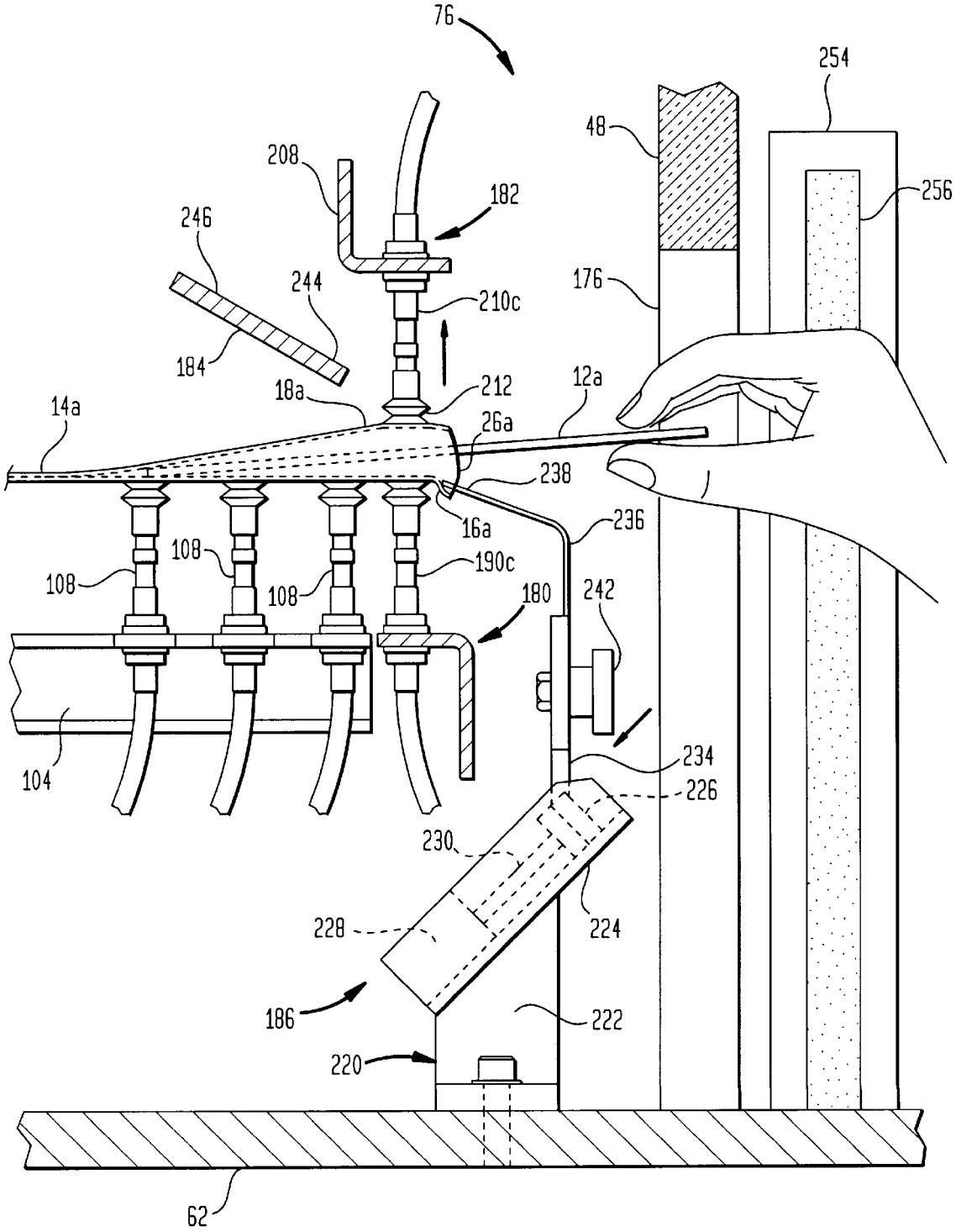
Figure 11D:
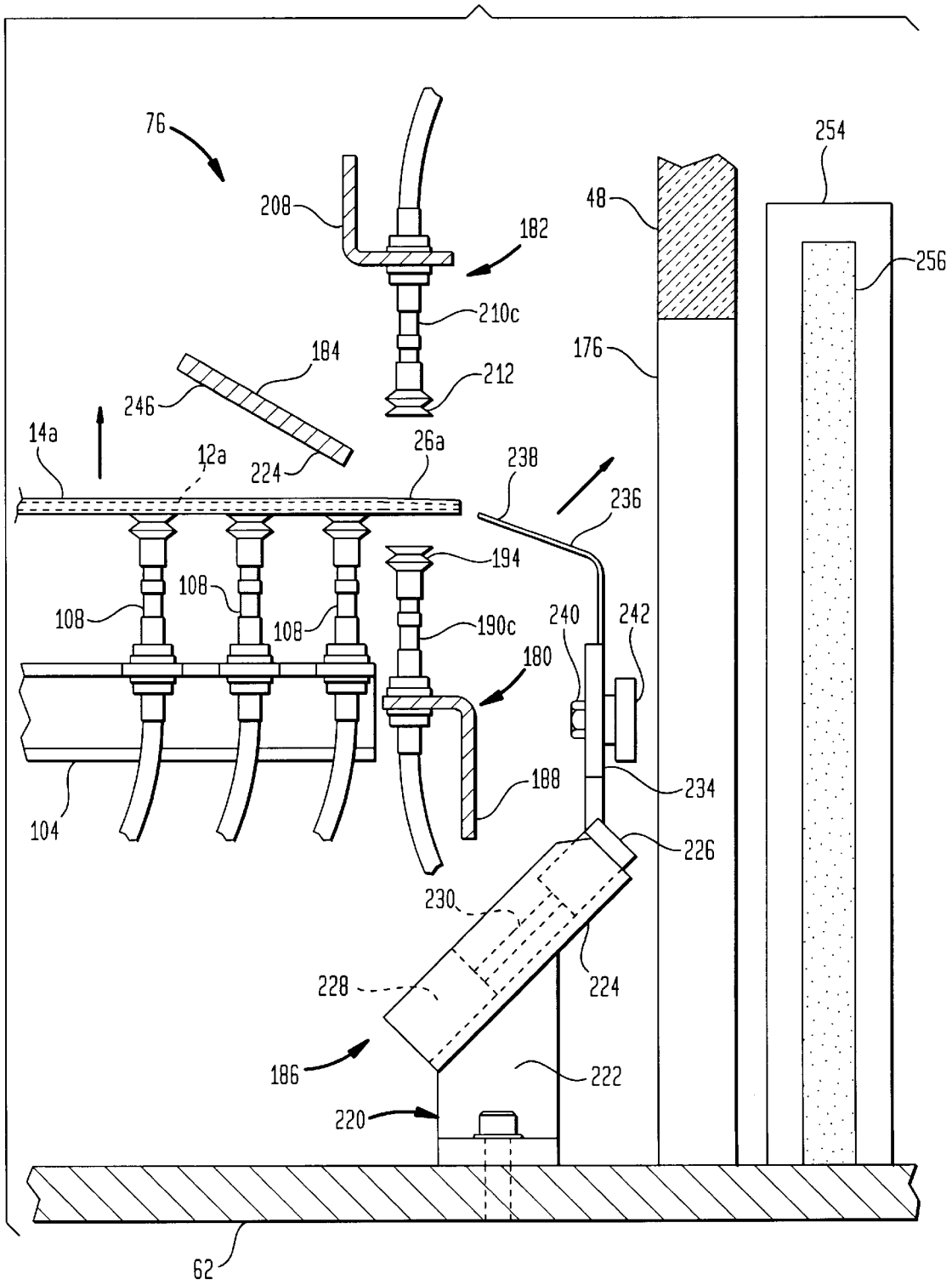
Figure 12:
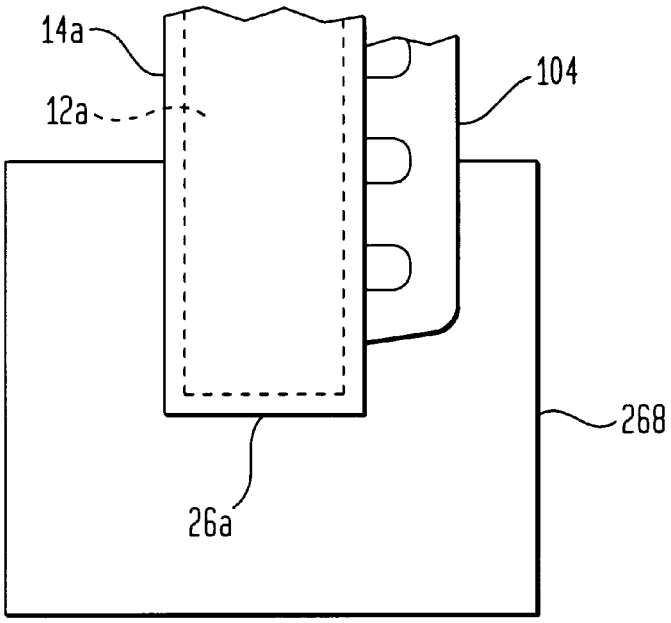
FIG. 12 is a schematic view of an inspection station of the packaging machine shown in FIGS. 1–3.
Figure 13:
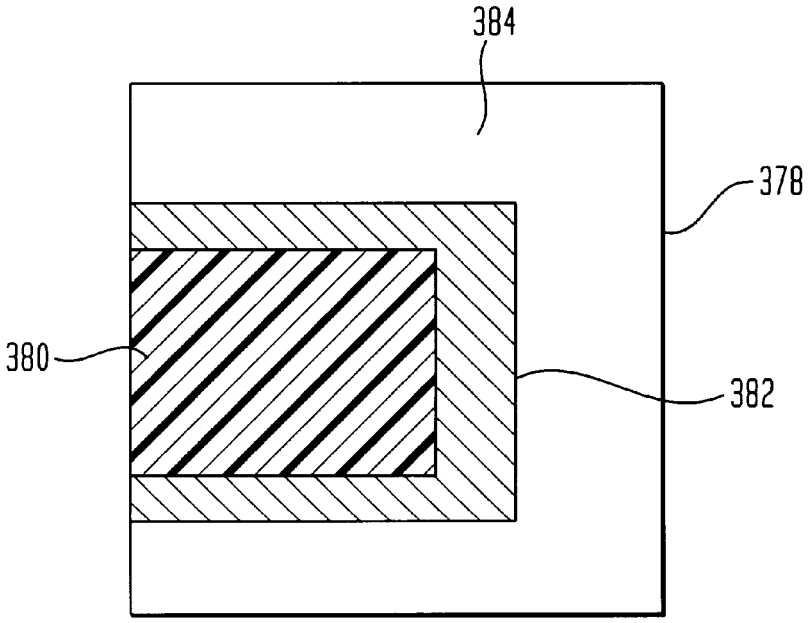
FIG. 13 is an illustration of an image of a stuffed overwrap containing contents taken by a camera of the inspection station shown in FIG. 12.

Facilitated by the tongue 236 depressing the front end of the semi-opaque sheet 16*a* of the overwrap 14*a*, the operator inserts (i.e., loads) the contents 12*a* into the overwrap 14*a* in proper position through the opening 176 of the safety panel 48 (see FIG. 11C). More particularly, the contents 12*a* are so positioned that the leading end 26*a* of the overwrap 14*a* is clear of the contents 12*a* (i.e., is not obstructed by the contents 12*a*). After the contents 12*a* are properly inserted (i.e., loaded) into the overwrap 14*a*, the operator triggers the switches 258 by touching them.

Upon receiving a signal from the switches 258, the controller 36 enables the infra-red light sensor units 252, 254 and then causes the light panel 260 to turn the green light 264 off and to turn the red light 262 on to indicate that it is not safe to insert foreign objects, such as an operator's hand, through the opening 176. In the event that an operator's hand and/or a foreign object are inserted into the machine section 32 through the opening 176 when the red light 262 is turned on (i.e., when the infra-red light sensor units 252, 254 are enabled), the light curtain 256 formed by the infra-red light sensor units 252, 254 is triggered. As a result, the infra-red light sensor units 252, 254 send a signal to the controller 36 to shut off the packaging machine 10, thereby preventing bodily injury to the operator and physical damage to the packaging machine 10.

After the red light 262 of the light panel 260 is turned on, the controller 36 activates the piston unit control valve 232 to move the tongue 236 to its upper position, thereby causing the tongue 236 to disengage the leading end 26*a* of the overwrap 14*a*. Next, the controller 36 causes the deactivation of the preselected one or ones of the opener suction sources 198*a*–198*c*. Thereafter, the suction units 210*a*–210*c* of the upper opener assembly 182 are caused to move upwardly to their upper position from their intermediate position (see FIG. 11D). As a result, the leading end 26*a* of the stuffed overwrap 14*a* (i.e., the unsealed overwrap 14*a* containing the contents 12*a*) is released from the suction cups 194, 212 of the lower and upper opener assemblies 180, 182, respectively, thereby completing the product insertion stage of the packaging operation.

Referring to FIGS. 1–3, 12, and 13, after the completion of the product insertion stage, the packaging machine 10 enters the inspection stage of the packaging operation. Accordingly, the controller 36 causes the robot arm assembly 72 to remove the end effector 104 and thus the stuffed overwrap 14*a* (i.e., the unsealed overwrap 14*a* containing the contents 12*a*) from the product insertion station 76 and to then position same at the inspection station 78 for computerized inspection of the leading end 26*a* of the overwrap 14*a*. More particularly, the robot arm assembly 72 places the leading end 26*a* of the overwrap 14*a* directly above the back-light 268 and between the camera 270 and same. The camera 270 then takes a digitized image 378 of the leading end 26*a* of the overwrap 14*a* and sends same to the controller 36.

Next, the controller 36 processes the image 378 for comparison to predetermined values. More particularly, because the contents 12*a* are opaque, the light transmitted from the back-light 268 is not transmitted through the contents 12*a* to the camera 270, the contents 12*a* are represented in the image 378 as a dark (e.g., black) area 380 (indicated by alternating thick and thin hatched lines in FIG. 13). On the other hand, because the leading end 26*a* of the overwrap 14*a* is clear of the contents 12*a* (i.e., is not obstructed by the contents 12*a*) and because the semi-opaque sheet 16*a* of the overwrap 14*a* partially transmits the light transmitted from the back-light 268 to the camera 270, the leading end 26*a* is represented in the image 378 as a shaded area 382 (indicated by single hatched lines in FIG. 13) having a shade lighter than that of the dark area 380. Similarly, because the space surrounding the overwrap 14*a* is clear of the overwrap 14*a*, it is represented in the image 378 as a bright area 384 (indicated by the non-hatched area in FIG. 13). By measuring the relative sizes of the dark, shaded and bright areas 380, 382, 384 in the image 378 and then comparing them to the predetermined values, the controller 36 automatically determines the following conditions: (i) whether the overwrap 14*a* and the contents 12*a* are present; (ii) whether the leading end 26*a* of the overwrap 14*a* is clear (i.e., unobstructed by the contents 12*a*) for sealing thereof; and (iii) whether the stuffed overwrap 14*a* (i.e., the unsealed overwrap 14*a* containing the contents 12*a*) is in proper orientation and/or position for the next stage (i.e., the sealing stage). If the controller 36 determines that all of the foregoing conditions are present, it causes the robot arm assembly 72 to move the end effector 104 and thus the stuffed overwrap 14*a* from the inspection station 78 to the sealing station 80, thereby completing the inspection stage of the packaging operation.

If it is determined that any of the foregoing conditions are not present, the controller 36 causes the robot arm assembly 72 to move the end effector 104 and thus the stuffed overwrap 14*a* back to the product insertion station 76, where the operator visually inspects the overwrap 14*a* and then makes any necessary adjustments to the overwrap 14*a* and/or the contents 12*a*. For instance, if the contents 12*a* are misaligned in the overwrap 14*a* and extends into the leading end 26*a* (i.e., if the contents 12*a* partially or completely obstruct the leading end 26*a*), the operator properly aligns the contents 12*a*. After making any necessary adjustments to the stuffed overwrap 14*a*, the operator triggers the switches 258, thereby causing the visually inspected overwrap 14*a* to be moved again to the inspection station 78 for inspection by the controller 36 in the manner discussed above. If it is determined again that the overwrap 14*a* is not in proper condition for the next stage (i.e., the sealing stage), the robot arm assembly 72 moves the overwrap 14*a* to the product insertion station 76 to be discarded by the operator. In such circumstances, after the overwrap 14*a* is removed from the end effector 104, the packaging machine 10 resets to the initial stage (i.e., the picking stage), thereby causing the end effector 104 to move to the picking station 74. Otherwise, the controller 36 causes the robot arm assembly 72 to move the end effector 104 and therefore the stuffed and inspected overwrap 14*a* to the sealing station 80 for the sealing stage of the packaging operation.

With respect to condition (iii) mentioned above, it should be noted be that the controller 36 can alternatively be programed to move the end effector 104 and thus the stuffed overwrap 14*a* from the inspection station 78 to the next station (i.e., the sealing station 80) even if it is determined that condition (iii) is not present. More particularly, in the event that the stuffed overwrap 14*a* is not properly oriented and/or positioned for the next stage (i.e., data computed from the digitized image 378 relating to the orientation and/or position of the stuffed overwrap 14*a* is out of a predetermined specification or predetermined values), the controller 36 can move the end effector 104 to the sealing station 80, rather than moving same back to the product insertion station 76, provided that the data is within a predetermined tolerance limit. In other words, the controller 36 can position the stuffed overwrap 14*a* in proper orientation and/or position for the sealing stage by processing the data and then adjusting the robot arm assembly 72 and/or the end effector 104. Concerning condition (ii), if it is not present (i.e., if the leading end 26*a* of the overwrap 14*a* is obstructed by the contents 12*a*), the end effector 104 is moved back to the product insertion station 76 for manual adjustment as mentioned above.

Figure 15:
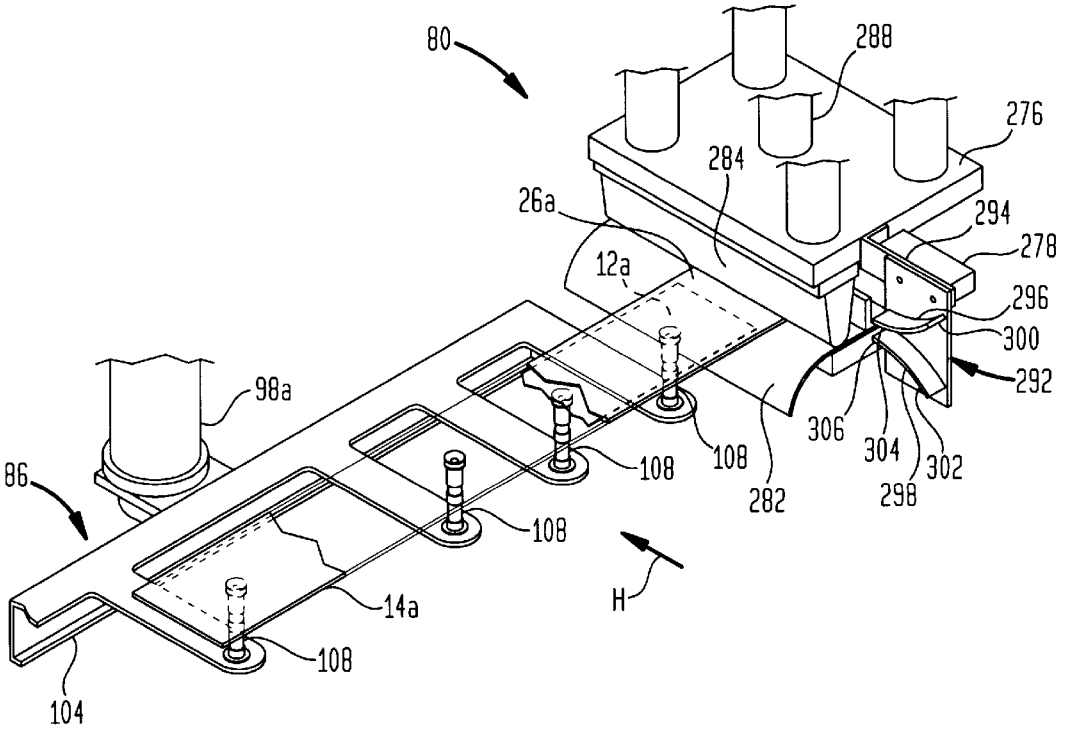
FIG. 15 is a perspective view of the sealing station shown in FIG. 14 after the positioning of a stuffed overwrap therein.

With reference to FIGS. 6 and 15, the controller 36 causes the robot arm 84 to move the end effector 104 from the inspection station to the sealing station sideways (as indicated by arrows H in FIG. 15). More particularly, after activating the air cylinder device 286 of the sealing station 80 to move the upper plate 276 into its upper position, the controller 36 causes the robot arm assembly 72 to move the end effector 104 into a predetermined position (see FIG. 15) relative to the sealing station 80. In such a position, the leading end 26*a* of the overwrap 14*a* is positioned in the space between the upper and lower plates of the sealing station 80. In this regard, the upper and lower members 296, 298 of the lead-in plate 292 guide the leading end 26*a* of the overwrap 14*a* to the space 290 formed between the upper and lower plates 276, 278 as the leading end 26*a* is positioned between the upper and lower plates 276, 278.

After the leading end 26*a* of the overwrap 14*a* is properly positioned in the space 290, the air cylinder device 286 is re-activated by the controller 36 to move the upper plate 276 into its lower position, depressing the heating die 284 against the rubber seal die 280 and thereby sandwiching the leading end 26*a* of the overwrap 14*a* between the rubber seal die 280 and the heating die 284. The heating die 284, which is continuously maintained at a preset temperature sufficient for sealing the leading end 26*a* of the overwrap 14*a* during the operation of the packaging machine 10, remains in contact with the leading end 26*a* of the overwrap 14*a* for a predetermined period of time so as to seal the leading end 26*a* of the overwrap 14*a*. Next, the controller 36 re-activates the air cylinder device 286 to cause the upper plate 276 to move to its upper position, thereby releasing the sealed leading end 26*a* of the overwrap 14*a* from the heating die 284 and the rubber seal die 280 and hence completing the sealing stage of the packaging operation.

With reference to FIGS. 17–20, after the completion of the sealing stage of the packaging operation, the controller 36 causes the ejector 316, which is initially located at its front position (see FIG. 1) and which is normally oriented in its lower position (see FIG. 17) so as not to interfere with the movement of the end effector 104, to move upwardly to its upper position (see FIG. 19) by activating the thruster control valve 336. Moreover, the robot arm assembly 72 causes the proximal and distal arms 90*a*, 90*b* to be oriented in another predetermined robot arm position (indicated by the broken line representation I of the robot arm 84 in FIG. 20), while the quill assembly 98 moves the end effector 104 downwardly towards the ejector 316 (as indicated by arrow J in FIG. 18) such that the suction units 108 of the end effector 104 are aligned with the suction units 350 of the ejector 316 in a meshing (i.e., alternating) fashion (see FIG. 18). With the end effector 104 and the ejector 316 so positioned, the ejector suction source 356 is activated so that the suction cups 350 are enabled to receive the sealed stuffed overwrap 14*a* and to grip same. With the end effector suction source 114 now deactivated, the controller 36 activates the rotary cylinder 122 of the end effector assembly 86 to move the end effector 104 into its lower position (indicated by the broken line representation of the end effector 104 in FIG. 5).

Figure 20:
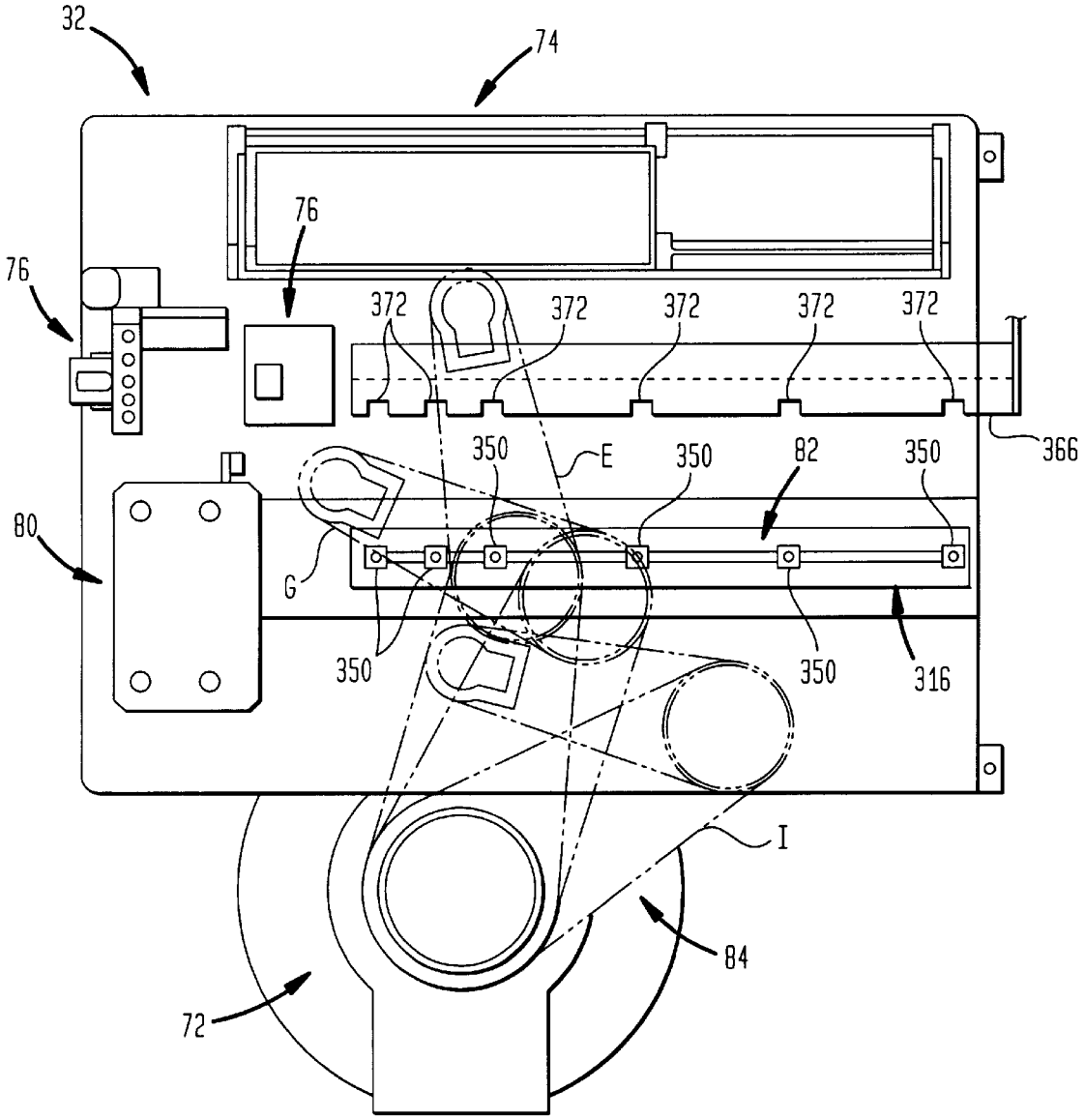
FIG. 20 is a schematic view of a machine section of the packaging machine shown in FIGS. 1–3.

Next, the controller 36 activates the slide control valve 326 so as to move the slide 324 and therefore the ejector 316 to their rear position, in which the suction units 350 of the ejector 316 are aligned with the cutouts 372 formed in the ejector chute 366 (see FIG. 20). The controller 36 then activates the ejector control valves 364 and therefore the rotary cylinders 362 to move the ejector 316 from its upright position (indicated by the broken line representation of the ejector 316 in FIG. 19) to its tilted position (indicated by the solid line representation of the ejector 316 in FIG. 19), in which the ejector 316 leans towards the upper portion 368 of the ejector chute 366. The ejector suction source 356 is then deactivated to release the sealed overwrap 14*a* from the suction units 350 of the ejector 316.

Upon release, the sealed overwrap 14*a* slides downwardly on the ejector chute 366 into the collector bin 374 and thereby activates the sensor 376. The sensor 376 then sends a signal to the controller 36 to cause the packaging machine 10 to reset to the initial stage of the next cycle (i.e., the picking station). If, for example, the sealed overwrap 14*a* falls off the ejector 316 prematurely and is not conveyed to the collector bin 374 (i.e., falls onto the floor), the sensor 376 is not triggered, and the controller 36 alerts the operator. Upon releasing the overwrap 14*a* and therefore unloading same from the packaging machine 10, the ejector 316 is caused to move back into its upright position (as indicated by the broken line representation of the ejector 316 in FIG. 19) and then into its lower position (see FIG. 17). Thereafter, the controller 36 causes the ejector 316 to move to its front position (see FIG. 1) in preparation for the next cycle.

It should be appreciated that the present invention provides numerous advantages over the prior art discussed above. For instance, because the robot arm 84 and the end effector 104 carry (i.e., transport) an associated overwrap from the picking station 74 to the product ejection station 82, the associated overwrap is not transferred (i.e., passed off) to another transporting device until the product ejection station 82 is reached. That is, the associated overwrap is continuously gripped by the suction cups 108 of the end effector 104 from the picking stage of the operation until the product ejection stage of the operation (i.e., throughout the product insertion stage, the product inspection stage, and the sealing stage of the operation). As a result, an overwrap is continuously gripped as it is carried from the tray 124 to the product insertion station 76, is opened by the lower and upper opener assemblies 180, 182, and is carried away from the product insertion station 76 after the insertion of contents into the overwrap. In such circumstances, because the overwrap is not passed off to another transporting device, the packaging machine 10 is more efficient and less complicated than the known packaging machines which employ multiple transporting devices.

It should be noted that the present invention can have numerous modifications and variations. For instance, another conventional transporting device can be used instead of the robot arm assembly 72. In addition, the ejector 316 can be eliminated and/or replaced by another ejector mechanism. In the event that the ejector 316 is eliminated, the robot arm assembly 72 drops a sealed stuffed overwrap directly onto the ejector chute 366 or into the collector bin 374. Moreover, the valves 200 can be omitted or replace by manual valves similar to those of the suction units 108. The valves 116 can also be automatically controlled by the controller 36. In addition, some or all of valves 116 can be collectively controlled in a manual or automatic manner.

It will be understood that the embodiment described herein is merely exemplary and that a person skilled in the art may make many further variations and modifications without departing from the spirit and scope of the invention.

All such variations and modifications are intended to be included within the scope of the invention as defined in the appended claims.

We claim:

1. Apparatus adapted for opening an open end of a pouch so as to facilitate the insertion of an object thereinto, comprising storing means located at a first station for storing a stack of open-ended pouches therein; opening means located at a second station for opening an open end of a pouch transported thereto from said first station, thereby enabling a pouch transported to said second station to receive an object; transporting means for transporting a pouch from said first station to said second station and then from said second station to a third station, said transporting means including first suction-operated gripping means, including a linear array of first suction cups, for gripping a pouch stored at said first station, said first gripping means continuously gripping a pouch throughout its movement from said first station to said third station; and unloading means located at said third station for unloading a pouch from said transporting means, said unloading means including second suction-operated gripping means, including a linear array of second suction cups, for gripping a pouch transported to said third station by said transporting means, said second gripping means operably positioned at said third station in such a manner that a pouch carried by said first gripping means can be passed directly to said second gripping means.

2. Apparatus according to claim 1, wherein said opening means includes third suction-operated gripping means for gripping a pouch transported to said second station by said transporting means, said third gripping means being movable relative to said first gripping means to thereby at least partially open a pouch transported to said second station by said transporting means.

3. Apparatus according to claim 2, wherein said opening means further includes fourth suction-operated gripping means which cooperates with said third gripping means to open a pouch transported to said second station by said transporting means.

4. Apparatus according to claim 3, wherein said first gripping means continuously grips a pouch during the performance of a pouch opening operation at said second station.

5. Apparatus according to claim 4, wherein said third gripping means is movable relative to said fourth gripping means.

6. Apparatus according to claim 5, wherein said first gripping means is substantially stationary during the performance of a pouch opening operation at said second station.

7. Apparatus according to claim 6, wherein said third and fourth gripping means are arranged on opposite sides of a pouch transported to said second station by said transporting means.

8. Apparatus according to claim 7, wherein said fourth gripping means is substantially stationary during the performance of a pouch opening operation at said second station.

9. Apparatus according to claim 8, wherein said third gripping means is movable toward and away from said fourth gripping means during the performance of a pouch opening operation at said second station.

10. Apparatus according to claim 9, wherein said third and fourth gripping means are arranged adjacent an open end of a pouch transported to said second station by said transporting means.

11. Apparatus according to claim 10, wherein said transporting means positions a pouch between said third and fourth gripping means prior to the performance of a pouch opening operation at said second station.

12. Apparatus according to claim 11, wherein said transporting means moves a pouch into close proximity to said fourth gripping means prior to the performance of a pouch opening operation at said second station.

13. Apparatus according to claim 12, wherein said third and fourth gripping means grip opposite sides of a pouch which is to be opened at said second station.

14. Apparatus according to claim 13, wherein said first and fourth gripping means are on a common side of a pouch which is to be opened at said second station.

15. Apparatus according to claim 14, wherein said opening means further includes depressing means for depressing an edge of an open end of a pouch during the performance of a pouch opening operation at said second station, whereby said depressing means cooperates with said third and fourth gripping means to open a pouch transported to said second station by said transporting means.

16. Apparatus according to claim 15, wherein said depressing means is releasably engageable with one side of a pouch which is to be opened at said second station.

17. Apparatus according to claim 16, wherein said depressing means includes a tongue which is movable between a first position, in which said tongue is out of engagement with a pouch which is to be opened at said second station, and a second position, in which said tongue is engageable with a pouch during the performance of a pouch opening operation at said second station.

18. Apparatus according to claim 17, wherein said tongue widens an open end of a pouch as said tongue moves from its said first position to its said second position.

19. Apparatus according to claim 3, wherein said first gripping means includes a first support member said first suction cups being arranged on said first support member and being positionable below a pouch which is therefore carried on said first suction cups throughout the movement of said first gripping means from said first station to said third station.

20. Apparatus according to claim 19, wherein said third gripping means includes a second support member and an array of third suction cups arranged on said second support member; and wherein said fourth gripping means includes a third support member and an array of fourth suction cups arranged on said third support member.

21. Apparatus according to claim 20, wherein each of said third suction cups is aligned with a corresponding one of said fourth suction cups.

22. Apparatus according to claim 21, wherein said third suction cups are linearly arranged on said second support member in a direction substantially parallel to a longitudinal axis of said second support member; and wherein said fourth suction cups are linearly arranged on said third support member in a direction substantially parallel to said longitudinal axis of said second support member.

23. Apparatus according to claim 22, wherein said first suction cups are linearly arranged on said first support member in a direction parallel to a longitudinal axis of said first support member, said first suction cups gripping a pouch in such a manner that its open end is positioned adjacent one end of said array of said first suction cups and is oriented substantially perpendicular to said longitudinal axis of said first support member.

24. Apparatus according to claim 23, wherein said longitudinal axis of said first support member is substantially perpendicular to said longitudinal axis of said second support member when said first gripping means is at said second station, whereby an open end of a pouch to be opened at said second station is substantially parallel to said longitudinal axis of said second support member.

25. Apparatus according to claim 24, wherein said first gripping means includes first actuating means for individually and selectively actuating at least some of said first suction cups, whereby the number of said first suction cups that are actuated can be varied depending upon pouch length.

26. Apparatus according to claim 25, wherein said first gripping means further includes first mounting means for mounting said first suction cups on said first support member such that said first suction cups are movable toward and away from said first support member.

27. Apparatus according to claim 26, wherein said first support member is a pivotable end effector of a robot arm assembly.

28. Apparatus according to claim 27, further comprising second actuating means for individually and selectively actuating at least some of said third suction cups and a corresponding number of said fourth suction cups, whereby the number of said third and fourth suction cups that are actuated can be varied depending upon pouch width.

29. Apparatus according to claim 28, wherein said third gripping means further includes second mounting means for mounting said third suction cups on said second support member such that said third suction cups are movable toward and away from said second support member; and wherein said fourth gripping means further includes third mounting means for mounting said fourth suction cups on said third support member such that said fourth suction cups are movable toward and away from said third support member.

30. Apparatus according to claim 19, wherein said opening means includes detecting means for detecting the presence of a pouch at said second station.

31. Apparatus according to claim 3, further comprising controlling means for controlling said first and second gripping means such that said first gripping means is deactuated upon the actuation of said second gripping means, whereby a pouch is transferable from said first gripping means to said second gripping means at said third station.

32. Apparatus according to claim 1, further comprising inspecting means positioned at a fourth station for inspecting a pouch transported thereto from said second station.

33. Apparatus according to claim 32, wherein said inspecting means includes a camera for taking an image of a pouch transported thereto from said second station.

34. Apparatus according to claim 33, further comprising sealing means located at a fifth station for sealing an open end of a pouch loaded with an object and transported thereto from said fourth station by said transporting means.

35. Apparatus according to claim 34, wherein said sealing means includes a heating element movable toward and away from an open end of a pouch positioned between said heating element and an opposing support member.

36. Apparatus according to claim 35, wherein said transporting means moves said first gripping means from said fourth station to said fifth station and then from said fifth station to said third station, said first gripping means continuously gripping a pouch throughout its movement from said first station to said third station.

37. Apparatus according to claim 33, further comprising a controller for processing an image of a pouch taken by said camera so as to determine whether a pouch transported to said fourth station from said second station is in proper position for a fifth station.

38. Apparatus according to claim 37, wherein said controller is programmed to adjust said transporting means so as to position a pouch, which is transported to said fourth station from said second station and which is determined to be in an improper orientation by said controller, in a proper orientation for said fifth station.

39. Apparatus according to claim 1, further comprising controlling means for controlling said first and second gripping means such that said first gripping means is deactuated upon the actuation of said second gripping means, whereby a pouch is transferable from said first gripping means to said second gripping means at said third station.

40. Apparatus according to claim 39, wherein said first gripping means includes a first support member, said first suction cups being arranged on said first support member and being positionable below a pouch which is therefore carried on said first suction cups throughout the movement of said first gripping means from said first station to said third station; and wherein said second gripping means includes a second support member, said second suction cups being arranged on said second support member and being positionable below a pouch carried by said first suction cups.

41. Apparatus according to claim 40, wherein said first and second suction cups are arranged in an alternating fashion relative to a pouch when said first and second gripping means are positioned at said third station.

42. Apparatus according to claim 41, wherein said first support member is a pivotable end effector of a robot arm assembly.

43. Apparatus according to claim 42, wherein said controlling means controls the actuation and deactuation of said first and second suction cups; and wherein said end effector is pivotable away from said third station upon the deactuation of said first suction cups and the actuation of said second suction cups.

44. Apparatus according to claim 43, wherein said second support member is pivotable in a direction opposite to said end effector.

45. Apparatus according to claim 44, wherein said controlling means deactuates said second suction cups after said second support member has been pivoted a predetermined distance to thereby release a pouch from said second gripping means.

46. Apparatus according to claim 1, further comprising first sensing means for sensing the presence of a pouch at said second station.

47. Apparatus according to claim 46, wherein said second station is accessible to an operator who is capable of inserting an object into a pouch transported to said second station by said transporting means.

48. Apparatus according to claim 47, further comprising second sensing means for sensing the presence of a foreign object, such as an operator's hand, at said second station, said second sensing means generating a signal in response to the presence of a foreign object at said second station and transmitting said signal to a controller which disables said apparatus upon receiving said signal from said second sensing means.

* * * * *